US009661900B2

(12) United States Patent
Matsushima et al.

(10) Patent No.: US 9,661,900 B2
(45) Date of Patent: May 30, 2017

(54) SLIDE FASTENER ATTACHMENT METHOD

(75) Inventors: Haruo Matsushima, Toyama (JP); Morimasa Yoneoka, Toyama (JP)

(73) Assignee: YKK Corporation (JP)

( * ) Notice: Subject to any disclaimer, the term of this patent is extended or adjusted under 35 U.S.C. 154(b) by 119 days.

(21) Appl. No.: 14/411,605

(22) PCT Filed: Jul. 5, 2012

(86) PCT No.: PCT/JP2012/067223

§ 371 (c)(1),
(2), (4) Date: Dec. 29, 2014

(87) PCT Pub. No.: WO2014/006725

PCT Pub. Date: Jan. 9, 2014

(65) Prior Publication Data

US 2015/0157097 A1 Jun. 11, 2015

(51) Int. Cl.
*A44B 19/62* (2006.01)
*A44B 19/26* (2006.01)
(Continued)

(52) U.S. Cl.
CPC ..... *A44B 19/26* (2013.01); *A44B 19/62* (2013.01); *B21D 53/52* (2013.01); *B21D 53/54* (2013.01); *Y10T 24/25* (2015.01); *Y10T 24/2582* (2015.01); *Y10T 24/2584* (2015.01); *Y10T 29/4973* (2015.01); *Y10T 29/49785* (2015.01)

(58) Field of Classification Search
CPC ..... B21D 53/52; B21D 53/54; A44B 19/62; A44B 19/384; A44B 19/403; A44B 19/46; A44B 19/52; A44B 19/58; A44B 19/42; A44B 19/02; A44B 19/28; Y10T 29/49785; Y10T 29/49783; Y10T 29/49782; Y10T 29/53291; Y10T 29/533
See application file for complete search history.

(56) References Cited

U.S. PATENT DOCUMENTS 1,675,053 A * 6/1928 Rothschild ..... A44B 19/28 24/406
2,032,438 A * 3/1936 Riecken ..... A44B 19/28 24/430
(Continued)

FOREIGN PATENT DOCUMENTS

JP 14-3226 Y1 3/1939
JP 49-103737 A1 10/1974
(Continued)

OTHER PUBLICATIONS

International Search Report, PCT Application No. PCT/JP2012/067223, mailed Oct. 9, 2012.
(Continued)

*Primary Examiner* — Jermie Cozart
(74) *Attorney, Agent, or Firm* — Kilpatrick Townsend & Stockton LLP

(57) ABSTRACT

The slide fastener attachment method includes: integrating, by welding or bonding, a fastener chain to which a segmented slider has not been attached and a fastener receiving member, and attaching the slider to the fastener chain after the integration. Thus, welding work operation efficiency is improved, and reduction of production cost can be expected.

8 Claims, 22 Drawing Sheets

(51) Int. Cl.
*B21D 53/52* (2006.01)
*B21D 53/54* (2006.01)

(56) References Cited

U.S. PATENT DOCUMENTS

| | | | | |
|---|---|---|---|---|
| 2,405,509 | A | 8/1946 | Marinsky | |
| 2,456,822 | A | 12/1948 | Erich et al. | |
| 2,839,807 | A | 6/1958 | Koppel et al. | |
| 3,353,256 | A * | 11/1967 | Hochlehnert | A44B 19/36 29/33.2 |
| 3,492,714 | A * | 2/1970 | Hochlehnert | A44B 19/36 29/768 |
| 3,574,247 | A | 4/1971 | Horst et al. | |
| 5,007,144 | A | 4/1991 | Terada et al. | |
| 5,297,320 | A | 3/1994 | Keyaki et al. | |
| 5,412,849 | A | 5/1995 | Fudaki et al. | |
| 8,082,635 | B2 * | 12/2011 | Leveau | A44B 19/28 24/416 |
| 8,539,651 | B1 | 9/2013 | Williams et al. | |
| 9,173,457 | B2 | 11/2015 | Lee | |
| 9,232,834 | B2 | 1/2016 | Keyaki et al. | |
| 2002/0050030 | A1 | 5/2002 | Takasawa | |
| 2010/0299886 | A1 * | 12/2010 | Fodge | A44B 19/28 24/419 |
| 2013/0276270 | A1 | 10/2013 | Hamada et al. | |
| 2015/0189954 | A1 | 7/2015 | Yoneoka et al. | |

FOREIGN PATENT DOCUMENTS

| | | | |
|---|---|---|---|
| JP | 2002-119310 | A | 4/2002 |
| JP | 4814391 | B1 | 9/2011 |
| WO | 2011024273 | | 3/2011 |

OTHER PUBLICATIONS

Non-Final Office Action, U.S. Appl. No. 14/411,676, mailed Oct. 5, 2016, 9 pages.
Restriction Requirement, U.S. Appl. No. 14/411,676, mailed Aug. 8, 2016, 6 pages.

* cited by examiner

SLIDE FASTENER ATTACHMENT METHOD

This application is a national stage application of PCT/JP2012/067223, which is incorporated herein by reference.

TECHNICAL FIELD

The invention relates to a slide fastener attachment method of attaching, by welding or bonding, a slide fastener to a fastener receiving member without sewing.

BACKGROUND ART

In general, when a slide fastener is attached to a fastener-attached product, such as clothing or a bag, a fastener tape of the slide fastener and the fastener-attached product are sewn together using a sewing machine, whereby the fastener tape and fastener-attached product are sewn by a sewing thread.

There is known a slide fastener (hereinafter, referred to as "waterproof slide fastener") having a waterproof property capable of preventing liquid from intruding into a fastener back side from a fastener front side under the condition that element rows are coupled as a whole.

When such a waterproof slide fastener is attached to the fastener-attached product, the following problem may occur. That is, when the sewing is performed for the waterproof slide fastener in the same manner as for a common type slide fastener, needle holes are formed by a needle (sewing machine needle) in the fastener tape or fastener-attached product although the fastener tape or fastener-attached product can be sewn together, disadvantageously allowing water intrusion through the needle holes or a sewing thread inserted into the needle hole, which results in deterioration of the waterproof property.

Thus, in conventional approaches, welding technique such as high-frequency welding or thermal welding is sometimes used, in place of sewing technique, for attachment of the waterproof slide fastener to the fastener-attached product.

Further, the welding technique used for attachment of the slide fastener can prevent an appearance defect which may be caused when the attachment is performed by the sewing technique. For example, when the attachment of the slide fastener is performed using the sewing technique, an appearance defect such as formation of a sewing line of the sewing thread or a phenomenon (sometimes called "puckering") in which a pair of fastener stringers are symmetrically curved outward in a tape width direction; on the other hand, the use of the welding technique for the attachment of the slide fastener can prevent such an appearance defect. Thus, the welding technique is sometimes used when the slide fastener is attached to a product required to have excellence in appearance or a product having excellent design.

An example of a method for attaching the slide fastener to the fastener-attached product by using the welding technique is described in, e.g., JP 4814391 B (Patent Document 1).

Patent Document 1 discloses a slide fastener attachment method capable of attaching, with a low defect rate, the slide fastener to a target member (hereinafter, referred to as "fastener receiving member"), such as a cloth member to which the fastener is attached in a desired curve pattern such that the slide fastener is curved in a tape width direction. Specifically, the slide fastener is attached as follows.

First, a template is used to curve the slide fastener into a desired curve pattern, and an adhesive sheet is attached to a front surface of a fastener tape of the slide fastener. Subsequently, an iron is used to heat the fastener tape to temporarily attach the adhesive sheet to the fastener tape. Then, hot press is applied, from a tape back surface side, to the fastener tape to the front surface of which the adhesive sheet has been temporarily attached, followed by cool press. As a result, a curved slide fastener having a desired curve pattern fixed by the adhesive sheet can be obtained.

Then, the obtained curved slide fastener is welded to the fastener receiving member. Specifically, first, a hot melt based on thermoplastic resin or rubber is formed on a back surface of the fastener receiving member. Then, an opening (pocket opening) having a shape corresponding to the curve pattern of the slide fastener is formed in an area where the hot melt of the fastener receiving member is formed.

Subsequently, the curved slide fastener is fixed to a template. At this time, the slide fastener is adhered to or fitted in the template such that the tape back surface of the fastener tape contacts the template. Then, the fastener receiving member is positioned such that the back surface of the fastener receiving member faces the slide fastener at the front surface side of the slide fastener fixed to the template and that the opening of the fastener receiving member is disposed corresponding to the element rows of the slide fastener. Then, an iron or the like is used to heat the hot melt to thereby temporarily fix the fastener receiving member and slide fastener.

After that, as illustrated in FIGS. 30(A) and 30(B), the fastener receiving member and slide fastener which have been temporarily fixed to each other are pressed from the front surface side of a fastener receiving member 100 using a high-frequency welder, or hot/cool-press machine.

At this time, since a slider is attached to the slide fastener, the pressing/welding is performed in two steps so as to prevent the slider from interfering with the press process. That is, as a first step, as illustrated in FIG. 30(A), in a state where the slider on the slide fastener is placed near one end portion side of the element rows, the pressing/welding is performed for an area including the fastener receiving member 100 and the other end portion side of the slide fastener.

Subsequently, the slider is slid to the other end portion side of the element rows, and, as a second step, as illustrated in FIG. 30(B), the pressing/welding is performed for an area including the fastener receiving member 100 and one end portion side of the slide fastener. At this time, in order for the slide fastener to be welded to the fastener receiving member 100 over the entire length thereof, the pressing/welding in the second step is performed so as to generate overlap between welding portions formed in the first and second steps. As a result, as illustrated in FIG. 31, the fastener receiving member 100 to which the slide fastener has been welded through the hot melt can be obtained.

By using the above slide fastener attachment method according to Patent Document 1, it is possible to attach, by welding, the slide fastener with a desired curve pattern to the fastener receiving member without sewing even in a state where the slider is attached to the slide fastener.

CITATION LIST

Patent Document

Patent Document 1: JP 4814391 B

SUMMARY OF INVENTION

Technical Problem

As described above, when the slide fastener attachment method according to Patent Document 1 is used to weld the slide fastener to the fastener receiving member through the hot melt while pressing the slide fastener to the fastener receiving member, the pressing/welding is performed in two steps while a position of the slider is changed, since the slider is attached to the slide fastener.

Thus, for such welding of the slide fastener, the pressing/welding needs to be performed at least in twice and, in addition, the slider needs to be slid from one end portion side to the other end portion side between the two steps. This deteriorates work efficiency in the welding and is identified as one of the factors that prevent cost reduction.

Further, as illustrated in FIG. 31, when the welding is performed such that the welding portions formed by the first and second steps are partly overlapped each other, a stepped portion is likely to occur in the overlapped portion between the welding portions, or the overlapped portion is likely to differ in color from other portions, which may degrade appearance quality.

When the high-frequency welding is used for the welding between the slide fastener and fastener receiving member, a high-frequency dielectric heating action is used to generate internal heat on and near an interface for the welding, and it takes a shorter time to complete the welding than in the thermal welding. Further, the welding portion can be finely finished.

However, if, for example, a conductive substance is adhered to the slide fastener or fastener receiving member, sparking occurs upon the high-frequency welding, which may damage the slide fastener or fastener receiving member. In particular, when the high-frequency welding is performed in a state where the slider is attached to the slider fastener, the sparking is likely to occur when a conductive substance is adhered to the slider. The above problem related to the high-frequency welding may occur for each welding. Therefore, the more the number of times of the welding as in the case of Patent Document 1 in which the welding is performed in two steps, the more likely the sparking occurs, which may reduce product quality or product yield due to damage of the slide fastener or fastener receiving member.

The invention has been made in view of the above conventional problems, and its concrete object is to provide a slide fastener attachment method capable of effectively and stably attaching the slide fastener to the fastener receiving member, improving appearance quality of a product more than before, and alleviating the problem of occurrence of the sparking upon the high-frequency welding.

Solution to Problem

To attain the above object, a slide fastener attachment method provided by the invention is, basically, a method of attaching a slide fastener in which at least one slider is attached to element rows of a fastener chain to a fastener receiving member by welding or bonding. The fastener attachment method includes, integrating the fastener chain to which the slider has not been attached and the fastener receiving member by welding or bonding; and attaching the slider to the fastener chain after integration of the fastener chain and the fastener receiving member.

In particular, in the slide fastener attachment method according to the invention, the slider preferably has a plurality of slider members capable of being assembled to each other and configured as a segmented slider in which the element rows can be inserted into an element guide passage of the slider at assembly of the plurality of slider members, and the attachment method preferably includes: coupling the element rows of the fastener chain; integrating the fastener chain to which the segmented slider has not been attached and the fastener receiving member by welding or bonding; partially separating the element rows of the fastener chain in a coupled state before or after the welding or bonding; and assembling the segmented slider and attaching the assembled segmented slider to a separated portion of the element rows at the same time.

The slide fastener attachment method according to the invention preferably includes: integrating the fastener chain in which the element rows are coupled to each other as a whole with the fastener receiving member through an adhesive film in a single welding operation; and partially separating, after the welding, the element rows before attachment of the segmented slider.

In this case, the slide fastener attachment method according to the invention preferably includes partially separating the element rows using an element separating member. Further, the attachment method according to the invention preferably includes forming, in the element rows, a fragile portion at which a coupling strength is made lower than that of the other portion of the element rows.

Further, the slide fastener attachment method according to the invention preferably includes attaching the slide fastener to a single fastener receiving member in which a predetermined opening is formed at a position corresponding to the element rows of the fastener chain. On the other hand, the slide fastener attachment method according to the invention may include attaching the slide fastener to a pair of fastener receiving members separated from each other.

Further, the slide fastener attachment method according to the invention preferably includes temporarily bonding the adhesive film to the fastener receiving member before the welding.

Further, in the slide fastener attachment method according to the invention, the slider preferably has at least a first slider member and a second slider member capable of being assembled to each other, and an inner wall surface of the element guide passage of the slider through which the element rows are inserted is preferably formed by the first slider member and second slider member.

Further, the slider preferably has a fixing member for retaining a state where the first slider member and second slider member are engaged with each other, the first slider member preferably has a first blade, a first guide post vertically installed on the first blade, and an insertion hole portion into which the fixing member is inserted, and the second slider member preferably has a second blade, a second guide post erected on the second blade so as to be engaged with the first guide post of the first slider member, and an insertion hole portion into which the fixing member is inserted.

Advantageous Effects of Invention

In the attachment method according to the invention, when the slide fastener is attached to the fastener receiving member, first, the fastener chain to which the slider has not been attached and fastener receiving member are put one over the other, and welding or bonding is performed with the fastener chain pressed against the fastener receiving member, whereby the fastener chain and fastener receiving member are integrated. Further, in the attachment method according to the invention, after the integration of fastener chain and fastener receiving member, the slider is attached to the fastener chain, whereby assembly of the slide fastener is completed.

As described above, according to the attachment method of the invention, the fastener chain to which the slider has not been attached is welded or bonded to the fastener receiving member, which eliminates the need to perform a work of sliding the slider during welding or bonding. Therefore, in the attachment method according to the invention, work efficiency can be improved more than a conventional method, and reduction of production cost of a product (hereinafter, referred to as "fastener receiving product") to which the slide fastener is attached can be achieved.

Further, in the attachment method according to the invention, even if a slider adhered with a conductive substance is used for the slide fastener in a case where high-frequency welding is used as a welding means for welding the slide fastener and fastener receiving member, it is possible to reduce a possibility that the sparking occurs, since the fastener chain to which the slider has not been attached and the fastener receiving member are welded to each other by high-frequency, to thereby suppress reduction in product quality or product yield due to occurrence of the sparking.

The fastener chain used in the invention refers to a fastener chain in which the element rows are at least partially coupled to each other in a pair of fastener stringers each provided with an element row to a fastener tape. Further, the fastener chain used in the invention includes a fastener chain in which a fastener tape is cut to a predetermined length dimension (dimension in a tape length direction) to form a single slide fastener and a fastener chain in which a plurality of element rows arranged in the tape length direction through a space portion are cut to a predetermined length dimension to form a plurality of slide fasteners.

More specifically, in the invention, the segmented slider is used as the slider to be attached to the fastener chain. The segmented slider includes a plurality of slider members capable of being assembled to each other and configured such that the element rows can be inserted into an element guide passage of the slider at assembly of the plurality of slider members.

Further, in the invention, welding or bonding is performed for the fastener chain to which the slider has not been attached and fastener receiving member for integration, as described above; however, before or after the integration, the element rows of the fastener chain in a coupled state are partially separated. Thereafter, the segmented slider is assembled using the plurality of slider members, and the assembled segmented slider is attached to a separated portion of the element rows, whereby assembly of the slide fastener is completed.

According to the attachment method of the invention, a need to perform a work of sliding the slider during the welding or bonding is eliminated as described above and, further, since the fastener chain to which the slider has not been attached is welded or bonded to the fastener receiving member, the fastener chain can be attached to the fastener receiving member in a single welding or bonding operation. Thus, in the attachment method according to the invention, it is possible to eliminate the need to carry out the welding in two or more like a conventional attachment method as disclosed in Patent Document 1, so that further improvement of work efficiency can be expected, and reduction of production cost of a fastener-attached product can be achieved.

Further, in the invention, the fastener chain can be firmly fixed to the fastener receiving member over the entire length of the fastener chain in a single welding or bonding operation, so that it is possible to suppress occurrence of a conventional problem, which may occur in a case where the welding is performed in two or more steps, i.e. an appearance problem such as formation of a stepped portion in the welding portion or a change in color at overlapped portion of the welding portion from other portion, which makes it possible to stably obtain a fastener-attached product with satisfactory appearance.

Further, in the attachment method according to the invention, even when high-frequency welding is used as a means for welding the slide fastener and faster receiving member, it is possible to further reduce a possibility that the sparking occurs, thereby further suppressing reduction in product quality or product yield due to occurrence of the sparking.

The above attachment method may further include integrating the fastener chain in which the element rows are coupled to each other as a whole with the fastener receiving member through an adhesive film in a single welding operation, and partially separating, after the welding, the element rows before attachment of the segmented slider. Integrating the fastener chain in which the element rows are coupled to each other as a whole, by welding, with the adhesive film and fastener receiving member stabilizes a position of the fastener tape in the fastener chain upon welding, thereby allowing the fastener chain to be stably welded to predetermined positions of the adhesive film and fastener receiving member. Further, partially separating the element rows after the welding allows the segmented slider to be easily attached to the separated portion of the element rows.

In this case, the attachment method according to the invention includes partially separating the element rows using an element separating member, thereby facilitating partial separation of the element rows after the welding.

Further, in this case, the attachment method according to the invention includes forming, in a part of the element rows, a fragile portion at which a coupling strength is made lower than that of the other portion of the element rows, thereby further facilitating partial separation of the element rows after the welding.

Further, the attachment method according to the invention can attach the slide fastener, by welding or bonding, to a single fastener receiving member in which a predetermined opening is formed at a position corresponding to the element rows of the fastener chain without sewing or can attach the slide fastener, by welding or bonding, to a pair of fastener receiving members separated from each other without sewing.

Further, the attachment method according to the invention includes temporarily bonding the adhesive film to the fastener receiving member before the welding, thereby stabilizing a positional relationship between the fastener receiving member and adhesive film. As a result, the fastener chain can be welded for integration to predetermined positions of the adhesive film and fastener receiving member.

In the attachment method according to the invention, the slider to be attached to the fastener chain integrated with the fastener receiving member has at least a first slider member and a second slider member capable of being assembled to each other, and an inner wall surface of the element guide passage of the slider through which the element rows are inserted is formed by the first slider member and second slider member. The slider having the thus configured first and second slider members can be easily attached to a part of the fastener chain where the element rows are separated.

Further, the slider used in the above invention further has a fixing member for retaining a state where the first slider member and second slider member are engaged with each other. In this case, the first slider member has a first blade, a first guide post vertically installed on the first blade, and an insertion hole portion into which the fixing member is inserted, and the second slider member has a second blade, a second guide post erected on the second blade so as to be engaged with the first guide post of the first slider member, and an insertion hole portion into which the fixing member is inserted.

The segmented slider having the thus configured first and second slider members and fixing member can be easily attached to a part of the fastener chain where the element rows are separated.

Further, by making the fixing member insertable/removable with respect to the first and second sliders, the segmented slider that has been once assembled can be separated into the first and second slider members. Thus, if failure or breakage occurs in the slider attached to the element rows of the fastener chain, the slider can be removed from the element rows after being separated into the first and second slider members and replaced with new one. That is, the slide fastener can be easily repaired.

Further, according to the invention, there is provided a product including the slide fastener attached to the fastener receiving member by the slide fastener attachment method having the above-described configuration. In such a product, the slide fastener is effectively attached to the fastener receiving member in the course of welding or bonding. Further, reduction in product yield due to occurrence of the sparking which may occur in a case where high-frequency welding is performed is unlikely to occur. Thus, it is possible to provide the product at lower cost.

Further, the product can be produced by attaching the fastener chain to the fastener receiving member in a single welding or bonding operation, so that it is possible to suppress occurrence of an appearance problem, such as formation of a stepped portion in the welding portion or a change in color at overlapped portion of the welding portion from other portion, which can make appearance of the product satisfactory.

DESCRIPTION OF EMBODIMENTS

Hereinafter, preferred embodiments of the invention will be described in detail with reference to the drawings. The invention is not limited to the embodiments described below, and various modifications can be made as long as the embodiments have a configuration which is substantially equivalent to the configuration of the invention and exhibit the same operational effects.

For example, in the following embodiments, a case where an element row of a fastener chain is constituted by continuous fastener elements each obtained by forming a monofilament into a coil shape; however, the slide fastener that can be used in the invention is not limited to the slide fastener provided with the coil shaped element row.

The invention may be applied to a case where a slide fastener in which the element row is constituted by continuous fastener elements obtained by molding monofilaments in a zig-zag pattern, a slide fastener in which the element row is constituted by synthetic resin fastener elements each of which is independently formed by injection molding, or a slide fastener in which the element row is constituted by metal fastener elements is attached to the fastener receiving member, similarly to the following embodiments.

Further, in the following embodiments, one slider is attached to the element rows of the fastener chain; however, in the invention, two sliders may be attached to the element rows of the fastener chain with the shoulder opening side end portions or rear opening side end portions of the two sliders facing each other.

First Embodiment

Figure 1:
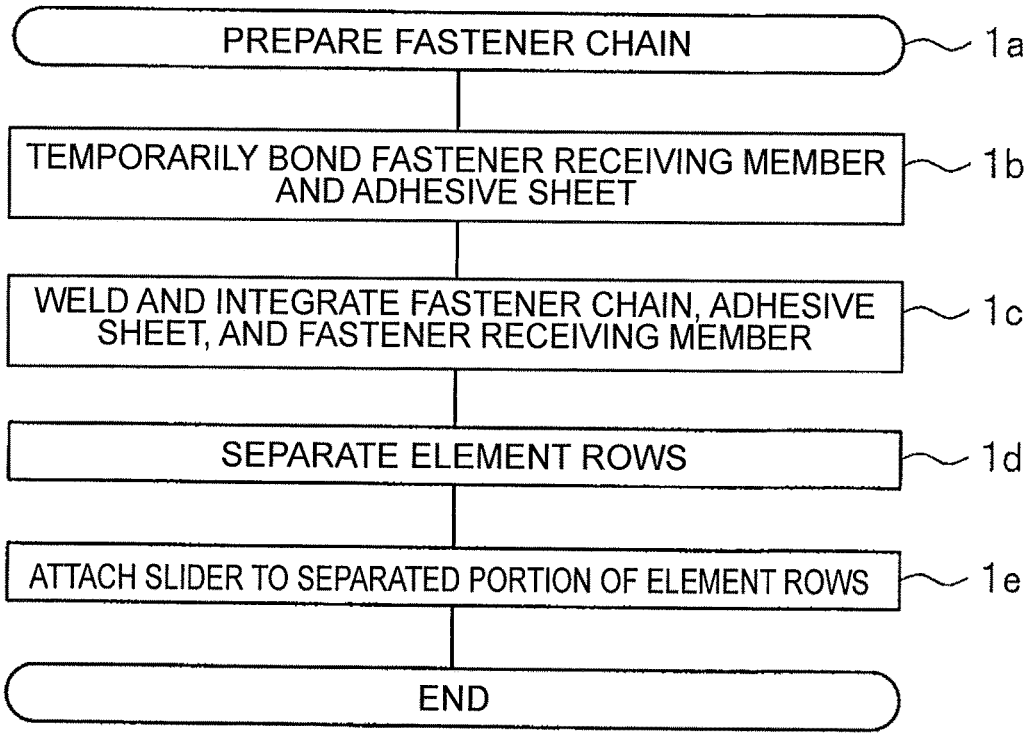
FIG. 1 is a flowchart illustrating a slide fastener attachment method according to a first embodiment of the invention.
Figure 2:
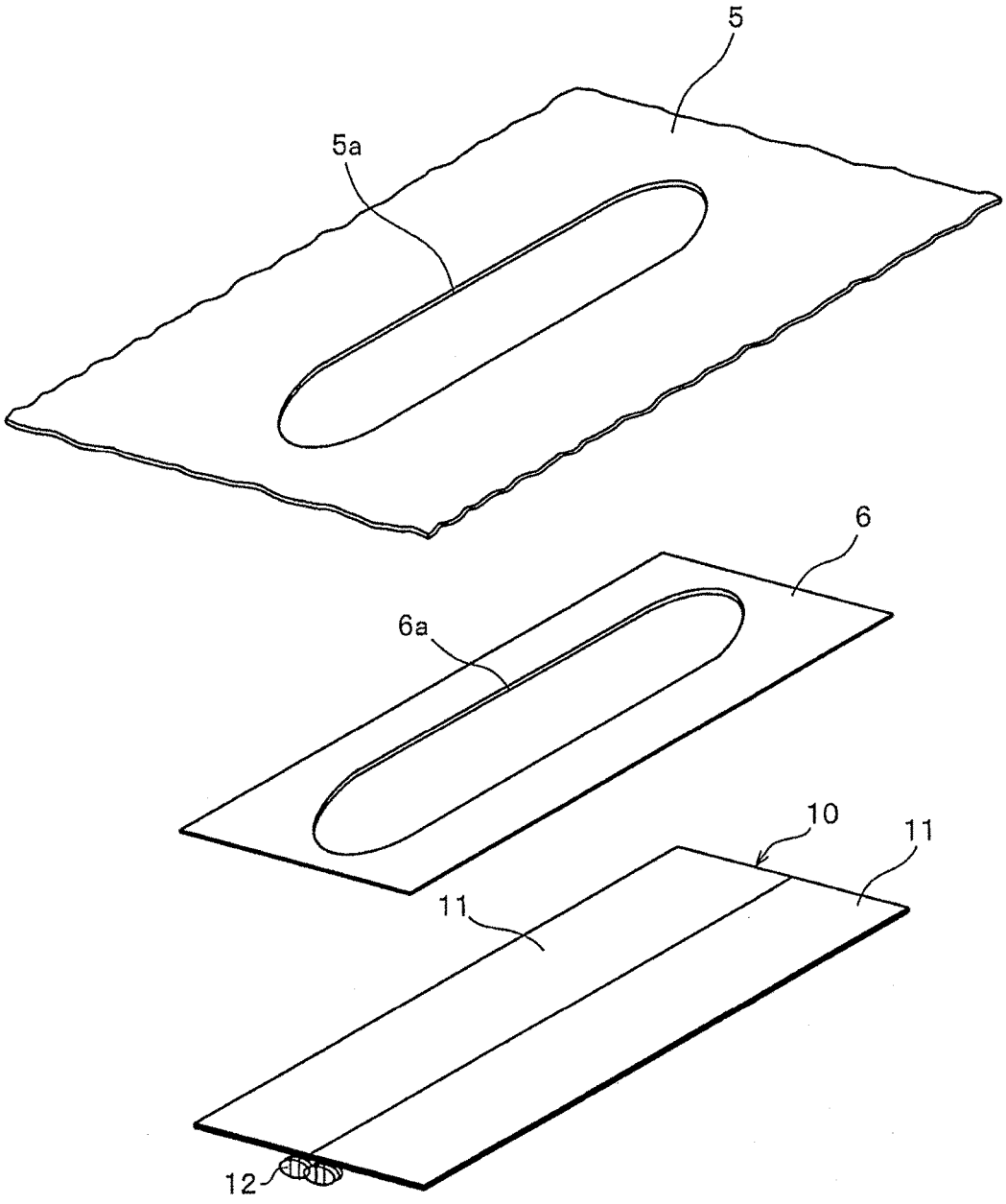
FIG. 2 is a perspective view illustrating a fastener chain, an adhesive film, and a fastener receiving member integrated by the attachment method.
Figure 3:
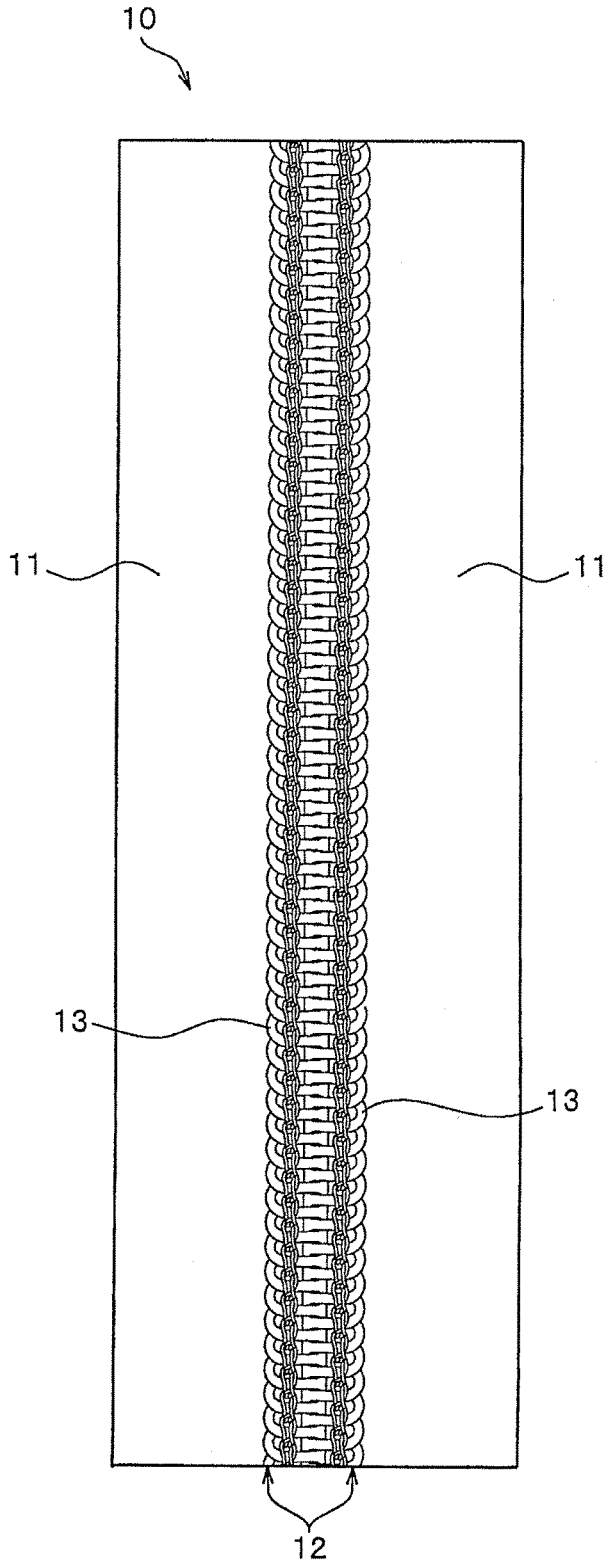
FIG. 3 is a bottom view of the fastener chain.
Figure 4:
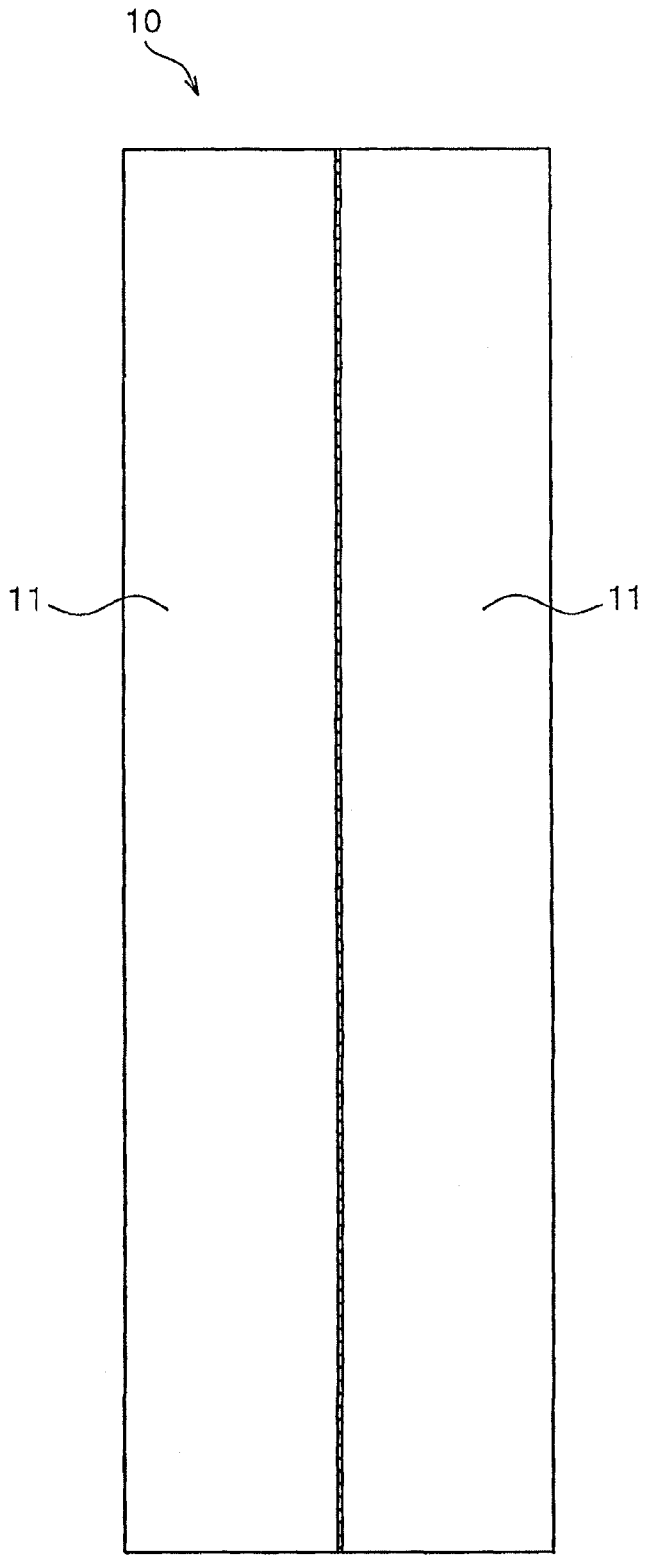
FIG. 4 is a plan view of the fastener chain.

FIG. 1 is a flowchart illustrating a slide fastener attachment method according to a first embodiment of the invention. FIG. 2 is a perspective view illustrating a fastener chain, an adhesive film, and a fastener receiving member integrated with one another by the attachment method. FIGS. 3 and 4 are a bottom view and a plan view of the fastener chain, respectively.

In the following description, a front-rear direction corresponds to a tape length direction of a fastener tape of the fastener chain. A left-right direction corresponds to a tape width direction of the fastener tape, which is a direction parallel to a tape surface of the fastener tape and perpendicular to the tape length direction. An up-down direction corresponds to a tape front surface-back surface direction perpendicular to the tape surface of the fastener tape. In particular, in the first embodiment in which the fastener chain is used with upside down, a side at which a coil-like fastener element of the fastener tape is provided is defined as a lower side, and its opposite side is defined as an upper side.

As illustrated in FIG. 2, in the attachment method according to the first embodiment, a fastener chain 10 for a slide fastener 15 to be attached is prepared and, as described later, a slider (first segmented slider) 20 to be attached to the fastener chain 10 is prepared separately from the fastener chain 10 (step 1*a* of FIG. 1). In addition, a fastener receiving member 5 to which the fastener chain 10 is attached and an adhesive film 6 disposed between the fastener chain 10 and fastener receiving member 5 are prepared.

As illustrated in FIGS. 3 and 4, the fastener chain 10 has a pair of left and right fastener tapes 11 and element rows 12 formed along tape side edge portions on second surfaces of the respective fastener tapes 11. The element rows 12 are each constituted by continuous fastener elements 13 each obtained by forming a monofilament into a coil shape.

On first surfaces of the fastener tapes 11, a water stop layer of a polyurethane-based, polyester-based, polyamide-based, or vinyl chloride-based thermoplastic elastomer is formed, to prevent permeation of liquid such as water into the fastener tapes 11. The formation of the water stop layer allows the fastener tapes 11 and adhesive film 6 to be welded stably and firmly when the first surface side of the fastener tapes 11 is welded to the adhesive film 6 as described later.

In the first embodiment, the first surface of each of the fastener tapes 11 is a surface of each of the fastener tapes 11 to be attached to the fastener receiving member 5 or the surface positioned outside when the slide fastener 15 is attached to the fastener receiving member 5 to manufacture a product 7.

The fastener element 13 of the first embodiment includes a coupling head, upper and lower leg portions extending in the tape width direction from the coupling head, and a connecting portion connecting an extended end portion of the upper leg portion to lower leg portion of the fastener element 13 adjacent in the tape length direction. The fastener element 13 receives insertion of a core thread between the upper and lower leg portions and is sewn to the fastener tape 11 in a state where the coupling head protrudes from the tape side edge of the fastener tape 11 to constitute the element row 12.

In the fastener chain 10 of the first embodiment, the entire element row 12 is constituted by the fastener elements 13 (normal element) each having the coupling head. However, as described later, the element rows 12 in a coupled state may be made easier to be partially separated from each other after welding process. In this case, for example, a fastener element (weakly coupled element) 13*a* whose coupling strength is reduced by cutting off the coupling head is used to constitute a part of the element row 12, thereby allowing a fragile portion 14 to be formed in the element row 12 (see FIG. 29).

In the first embodiment, the left and right element rows 12 of the fastener chain 10 are previously coupled to each other over the entire length direction, and this coupled state is maintained. Further, in the fastener chain 10 is configured so that the left and right fastener tapes 11 are slightly separated from each other in the coupled state of the element rows 12. The slider 20 is not attached to the element rows 12 of the fastener chain 10.

Further, a not illustrated stopping tool defining a slidable range of the slider 20 when the slider 20 is attached to the element rows 12 is provided at one end portion (front end portion) of the element row 12 of the fastener chain 10 and the other end portion (rear end portion) thereof. In the invention, a configuration of the stopping tool is not especially limited. For example, the stopping tool may be formed by pressing and crushing the fastener element 13 at a predetermined position, attaching a film to a predetermined position of the element row 12, or sewing a thread to a predetermined position of the element row 12.

Further, in the invention, the fastener chain 10 may be configured such that inner edges of the left and right fastener tapes 11 are brought into close contact with each other in the coupled state of the element rows 12. Further, in the first embodiment, the fastener chain 10 before welding to be described later is maintained in a state where the element rows 12 are coupled to each other over the entire length direction of the element. However, in the fastener chain before welding of the invention, it is sufficient that the left and right element rows are coupled at least partially. Thus, as in, e.g., a second embodiment to be described later, the fastener chain 10 before welding to be described later can be maintained in a state where the element rows 12 are intentionally partially separated from each other.

The fastener receiving member 5 is a member to which the slide fastener 15 is attached. For example, as the fastener receiving member 5, a cloth member such as fabric, a synthetic resin sheet member, a leather member, or the like is used. Preferably, the fastener receiving member 5 has a waterproof property capable of preventing permeation of liquid such as water into an inside. For example, attachment of a synthetic resin film to at least one of front and back surfaces of the fastener receiving member 5 allows the member 5 to have the waterproof property. Alternatively, a thermoplastic elastomer or a synthetic rubber may be coated on one of the front and back surfaces of the fastener receiving member 5.

An opening (hole portion) 5*a* is formed in the fastener receiving member 5 so as to correspond to a position of the element rows 12 of the fastener chain 10 (slide fastener 15). Having the opening 5*a* allows the slider 20 to be smoothly slid to easily open/close the slide fastener 15 in a state where the slide fastener 15 is attached to the fastener receiving member 5.

In the invention, as the fastener receiving member, a pair of fastener receiving members separated from each other may be used in place of a single fastener receiving member 5 having the opening 5*a* described above. In this case, by performing welding to be described later with a pair of fastener receiving members separated from each other by a predetermined interval put on the fastener chain 10, the fastener chain 10 can be welded to the pair of fastener receiving members.

The adhesive film 6 is formed of a thermoplastic resin or elastomer. By heating the adhesive film 6 while bringing the same into press contact with other member and then cooling it, welding of the adhesive film 6 and other member can be achieved.

In the invention, a material of the adhesive film 6 is not specifically limited, and a conventionally-known common adhesive film may be used. In this case, as is the case with the fastener receiving member 5, an opening (hole portion) 6*a* is formed on the adhesive film 6 so as to correspond to the position of the element rows 12 of the slide fastener 15.

However, the adhesive film need not always be used for the welding between members. For example, a weldable material may be interposed between the members to be welded. Alternatively, a weldable material may be coated, or a target weldable member itself may be melted to be stuck to the other thereof.

Further, in the first embodiment, the fastener chain 10 and fastener receiving member 5 are welded to each other through the adhesive film 6 for integration; however, in the invention, an adhesive may be used to bond the fastener chain 10 and fastener receiving member 5 for integration. In this case, the adhesive to be used may be selected arbitrarily from various adhesives such as a solvent vaporizing type adhesive, a thermally curable type adhesive, a two-liquid curing type adhesive, and a film-like adhesive.

Figure 5:
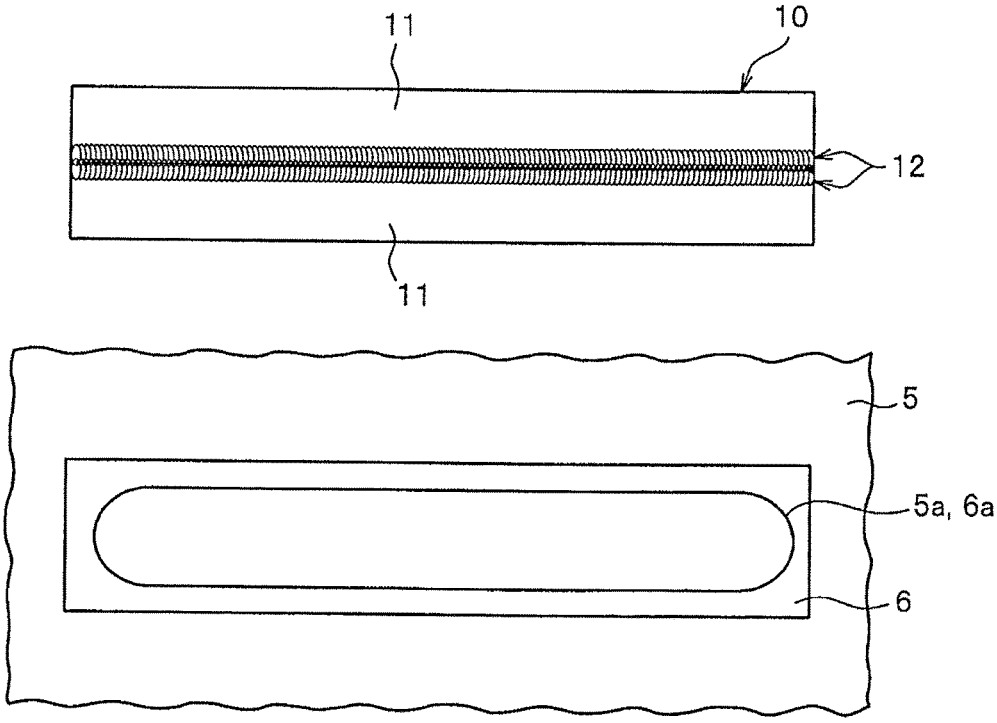
FIG. 5 is a schematic view illustrating a relationship between the fastener chain and temporarily bonded adhesive film and fastener receiving member.

In the first embodiment, before the fastener chain 10 is welded to the fastener receiving member 5, the adhesive film 6 is previously temporarily bonded (fixed) using an iron to a surface (lower surface) of the fastener receiving member 5 on which the fastener chain 10 is welded, as illustrated in FIG. 5 (step 1*b* of FIG. 1).

In this case, the openings 5*a* and 6*a* of the respective fastener receiving member 5 and adhesive film 6 may be previously formed by cutting before the adhesive film 6 is temporarily bonded to the fastener receiving member 5. However, in consideration of work efficiency and alignment between the openings 5*a* and 6*a*, it is preferable that the openings 5*a* and 6*a* are formed simultaneously after the adhesive film 6 is temporarily bonded to the fastener receiving member 5.

In the invention, the temporary bonding between the fastener receiving member 5 and adhesive film 6 may be omitted. In this case, in the welding step, the fastener chain 10, adhesive film 6, and fastener receiving member 5 can be welded and integrated simultaneously.

Then, welding is performed in a state where the prepared fastener chain 10 and fastener receiving member 5 to which the adhesive film 6 has been temporarily bonded are put one over the other (step 1*c* of FIG. 1). Specifically, the positions of the openings 5*a* and 6*a* of the respective fastener receiving member 5 and adhesive film 6 are made to correspond to a position of the element rows 12 on the first surface side of the fastener tape 11, and the fastener receiving member 5 is put one over such that the adhesive film 6 contacts the fastener chain 10. At this time, the left and right element rows 12 of the fastener chain 10 are coupled to each other over the entire length direction as described above.

Subsequently, welding is performed by applying heat for welding to and near the adhesive film 6 with the fastener chain 10 pressed against the fastener receiving member 5 at a predetermined pressure. As a result, the adhesive film 6 is firmly fixed to the upper surface of the fastener chain 10 and the lower surface of the fastener receiving member 5, whereby the fastener chain 10, adhesive film 6, and fastener receiving member 5 are integrated.

In the invention, a welding means for performing welding of the fastener chain 10 is not especially limited. The welding means to be used may be selected arbitrarily from various welding means such as a thermal welding means that performs heating by heat conduction from a heat source, a high-frequency welding means that generates internal heat using a high-frequency dielectric heating action, and an ultrasonic welding means that generates friction heat by transmission of fine ultrasonic vibration. In particular, the high-frequency welding means is preferably used since it can effectively heat a target object at short times and finely finish the welding portion.

In this case, since the slider 20 has not yet been attached to the fastener chain 10, existence of the slider does not become obstructive for the welding, as in the case of Patent Document 1, but the entire length of the fastener chain 10 can be welded to the fastener receiving member 5 through the adhesive film 6 while being pressed against the fastener receiving member 5. As a result, the fastener chain 10, adhesive tape 6, and fastener receiving member 5 can be effectively integrated over the entire length direction of the fastener chain 10 in a single welding operation.

As described above, in the first embodiment, the fastener chain 10 can be effectively attached to the fastener receiving member 5 in a single welding operation, so that work efficiency is improved, and reduction of production cost can be expected. Further, in the first embodiment, the fastener chain 10 is attached to the fastener receiving member 5 in a state where the left and right element rows 12 of the fastener chain 10 are coupled to each other as a whole, so that the fastener chain 10 (in particular, fastener tape 11) can be stably attached to a predetermined position of the fastener receiving member 5.

Further, the entire length of the fastener chain 10 is firmly welded to and integrated with the fastener receiving member 5 in a single welding operation, thereby suppressing occurrence of a defect such as formation of a stepped portion in the welding portion between the welded fastener chain 10 and fastener receiving member 5 or a change in color of the welding portion, which can make appearance of the welding portion satisfactory.

In particular, when the high-frequency welding means is used as the welding means, the following advantage can be obtained. That is, even if a conductive substance is adhered to the slider 20, for example because the slider 20 is not attached to the fastener chain 10 to be welded, a possibility that the sparking occurs upon welding can be reduced, thereby suppressing reduction in product quality or product yield of the product due to occurrence of the sparking.

In the invention, in place of welding the fastener chain 10 and fastener receiving member 5 through the adhesive film 6, it is possible to bond the fastener chain 10 and fastener receiving member 5 for integration by using, e.g., an adhesive such as a thermally curable type adhesive or a two-liquid curing type adhesive.

After completion of the above welding between the fastener chain 10 and fastener receiving member 5, a process of separating the element rows 12 of the fastener chain 10 is performed (step 1*d* of FIG. 1). In the first embodiment, since welding is performed to the fastener receiving member 5 in a state where the element rows 12 of the fastener chain 10 are coupled to each other as a whole, the left and right element rows 12 in a coupled state are partially forcibly separated for a subsequent slider attachment process.

Figure 6:
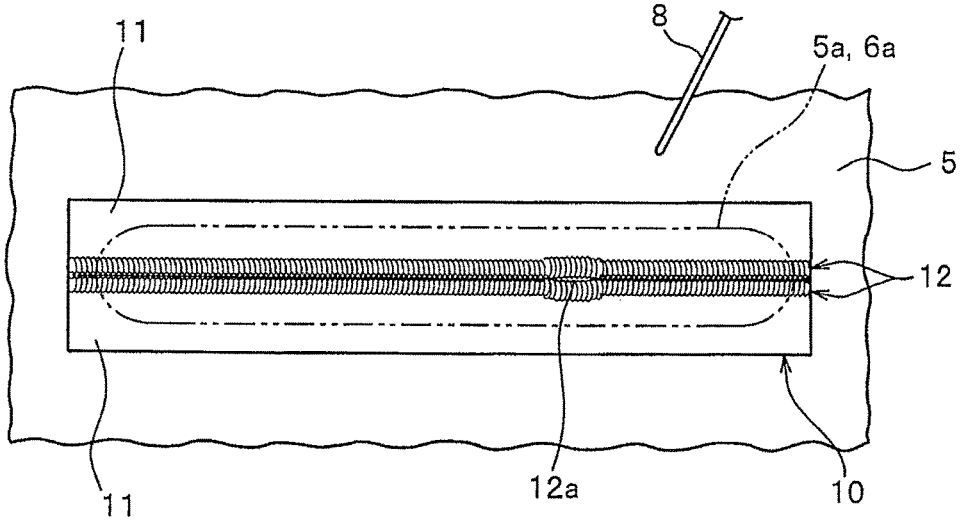
FIG. 6 is a bottom view illustrating a state where element rows are separated after the fastener chain is welded to the adhesive film and fastener receiving member.
Figure 7:
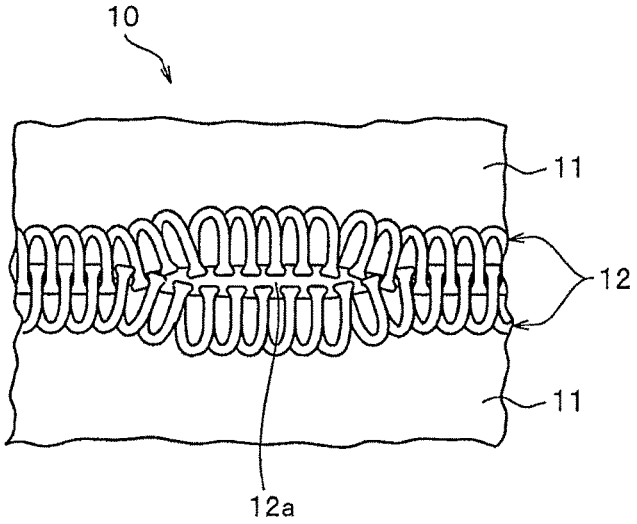
FIG. 7 is an enlarged view illustrating a part where the element rows of the fastener chain are separated.

Specifically, an elongated rod-like element separating member (jig) 8 is used to press an leading end of the element separating member 8 against a portion (in particular, coupling head) within an area in the element rows 12 of the fastener chain 10 between the stopping tools, at which the left and right fastener elements 13 are coupled to each other to locally apply a stress in the tape front surface-back surface direction to thereby partially separate the element rows 12 from each other in the left and right, as illustrated in FIGS. 6 and 7. In this case, the position at which the element rows 12 are separated from each other is not especially limited, and may be arbitrary determined as long as it exists within the area between the stopping tools of the element rows 12.

Further, in the invention, the element separating member 8 is not limited to that illustrated in FIG. 6, but other members that can locally apply a stress to the element rows may be used. Further, in a case where a coupling strength between the left and right element rows 12 is not so high to allow the element rows 12 in a coupled state to be separated by human hands, the separation of the element rows 12 can be performed by the human hands without using the above element separating member 8.

Figure 29:
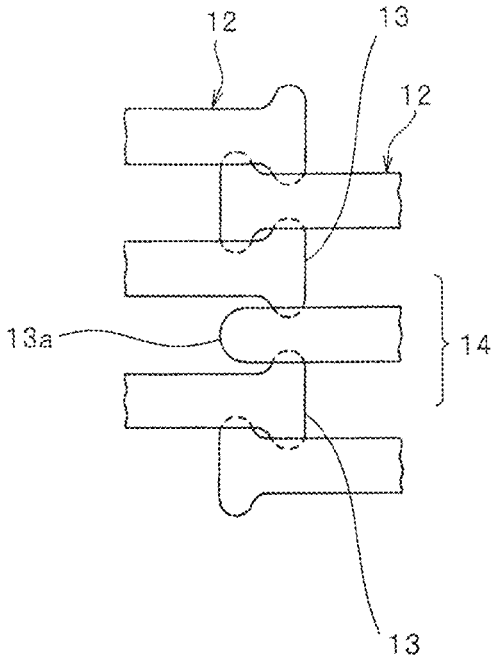
FIG. 29 is a schematic view illustrating a fragile portion provided in the element row of the fastener chain.
Figure 30:
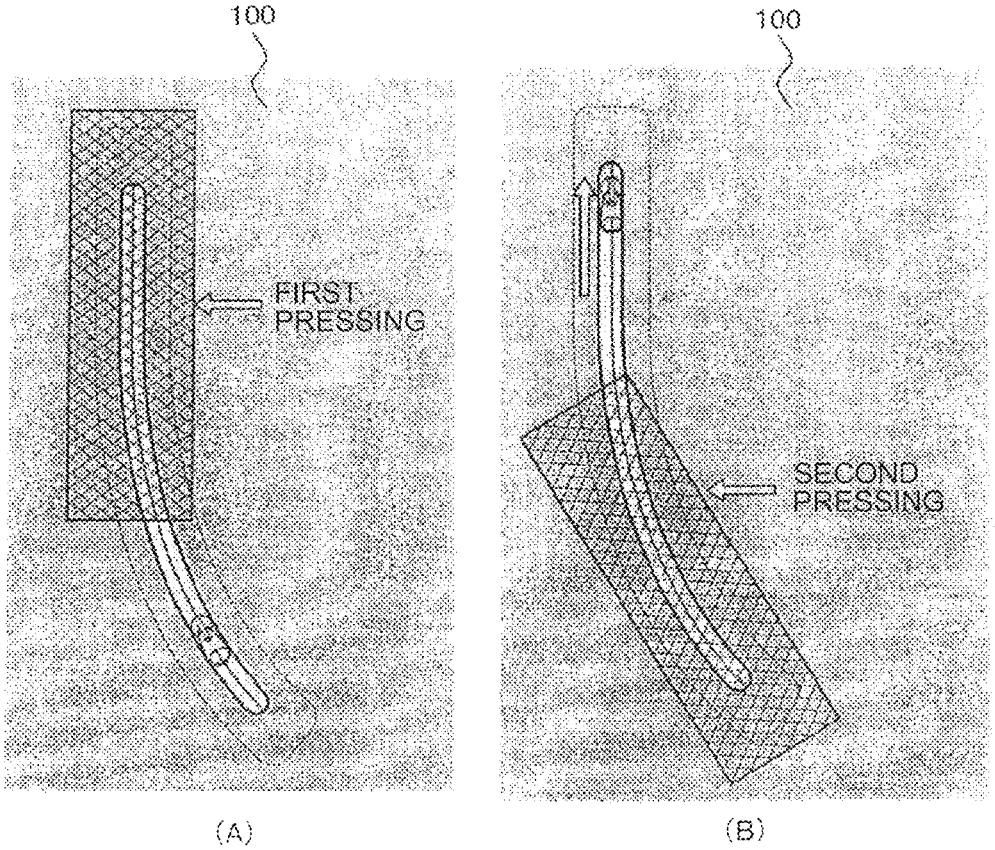
FIG.30 PRIOR ART
FIGS. 30(A) and 30(B) are explanatory views for explaining a welding method employed to attach a conventional slide fastener to the fastener receiving member.
Figure 31:
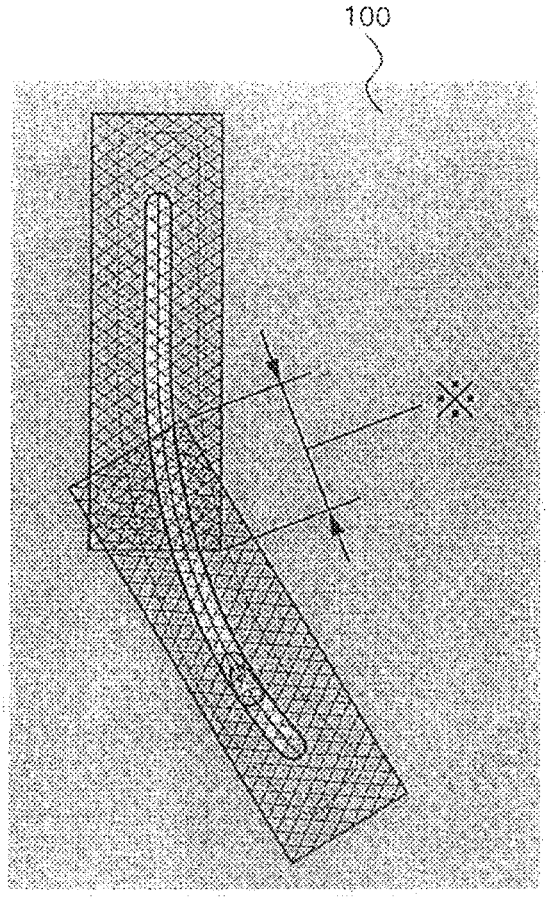
FIG.31 PRIOR ART
FIG. 31 is a schematic view illustrating the fastener receiving member to which a conventional slide fastener has been welded.

Further, in the invention, as described above, it is possible to previously form the fragile portion 14 at which the coupling strength is reduced by providing, at a part of the element row 12, the weakly coupled element 13*a* as illustrated in FIG. 29, which does not have the coupling head. By using the normal elements 13 and weakly coupled element 13*a* to constitute the element row 12 so as to form the fragile portion 14 including weakly coupled element 13*a* for a part of the element row 12, it is possible to easily separate the element rows 12 in a coupled state from each other at the fragile portion 14.

A configuration of the weakly coupled element is not especially limited as long as it has a coupling strength lower than that of the normal element 13. For example, it is possible to form the weakly coupled element by shortening a length of the coupling head as compared to the length of the part of the normal element 13. Further, the configuration of the weakly coupled element is not especially limited to a configuration of the element, but may be applied to other element configurations described above.

Figure 10:
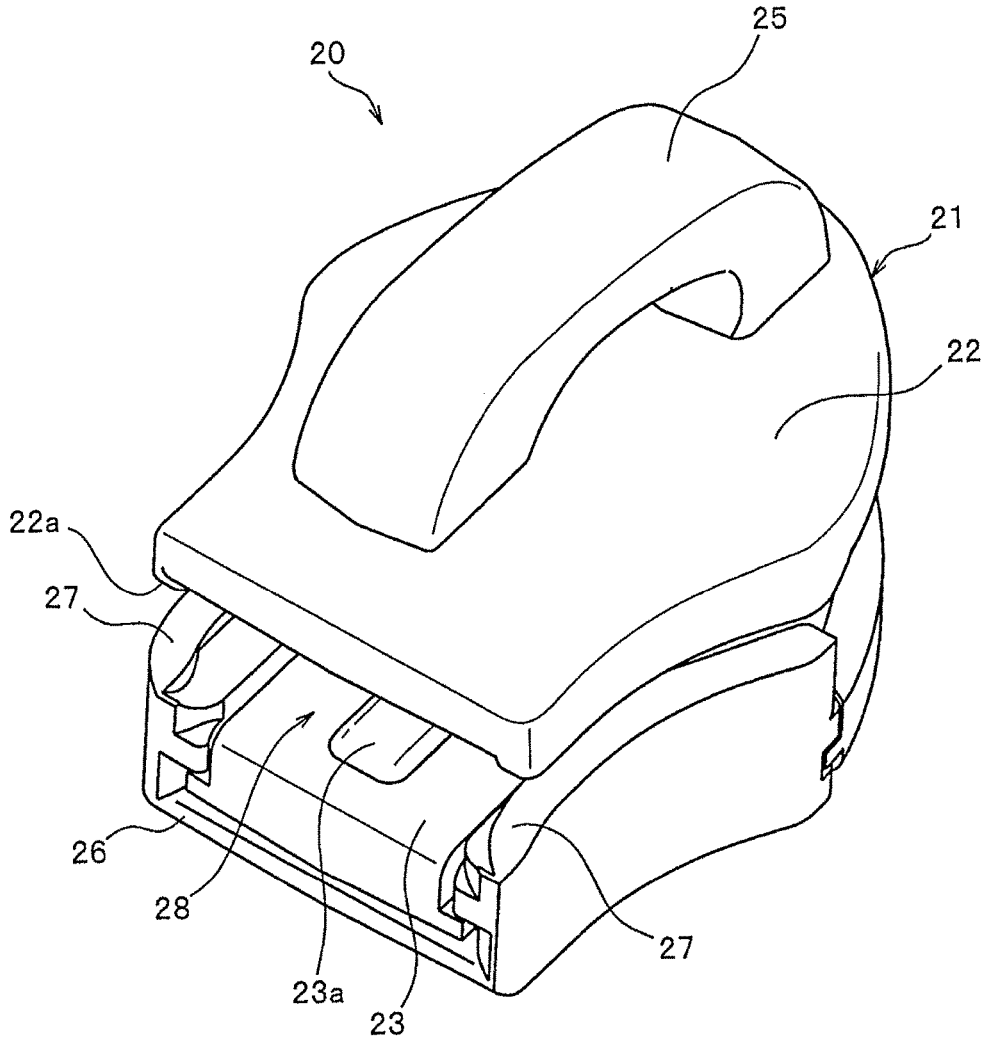
FIG. 10 is a perspective view illustrating a slider body of a first slider that can be attached to the element rows of the fastener chain.

Then, in the first embodiment, after completion of the above partial separation of the element rows 12, a process of attaching the slider 20 to a portion at which the element rows 12 are separated (step 1*e* of FIG. 1) is performed. For example, as a slider to be attached to the separation portion of the element rows 12, the slider (first segmented slider) 20 as illustrated in FIG. 10 is used.

The first segmented slider 20 includes a slider body 21 and a tab not illustrated, rotatably retained by the slider body 21. The slider body 21 includes an upper blade (first blade) 22, a lower blade (second blade) 23, a guide post 24 connecting shoulder opening side end portions of the respective upper and lower blades 22 and 23, a tab attaching post 25 provided on an upper surface side of the upper blade 22, a base 26 fitted to a lower surface side of the lower blade 23, and a lower flange portion 27 provided along left and right side edge portions of the lower blade 23.

Further, a first bulge portion 22*a* and a second bulge portion 22*b* are formed on a lower surface (inner surface) of the upper blade 22 in order to prevent an increase in sliding resistance due to sliding contact of the fastener tape 11 of the slide fastener 15 to the entire lower surface of the upper blade 22. The first bulge portion 22*a* is provided along left and right side edge portions of the lower surface of the upper blade 22, and the second bulge portion 22*b* is provide at a center of the lower surface of the upper blade 22 so as to extend from the guide post 24 to a rear end portion (rear opening side end portion). On the other hand, on an upper surface (inner surface) of the lower blade 23, a third bulge portion 23*a* for guiding the fastener element 13 is formed so as to extend rearward from the guide post 24.

Further, left and right shoulder openings are formed at a front end of the slider body 21 with the guide post 24 interposed therebetween, and a rear opening is formed at a rear end of the slider body 21. Further, a substantially Y-shaped element guide passage 28 is formed so as to make the left and right shoulder openings and rear opening communicate with each other. The guide path 28 is surrounded by the upper blade 22, lower blade 23, and lower flange portion 27. Further, a tape insertion gap through which the fastener tape 11 is inserted is formed between the upper blade 22 and lower flange portion 27.

Figure 11:
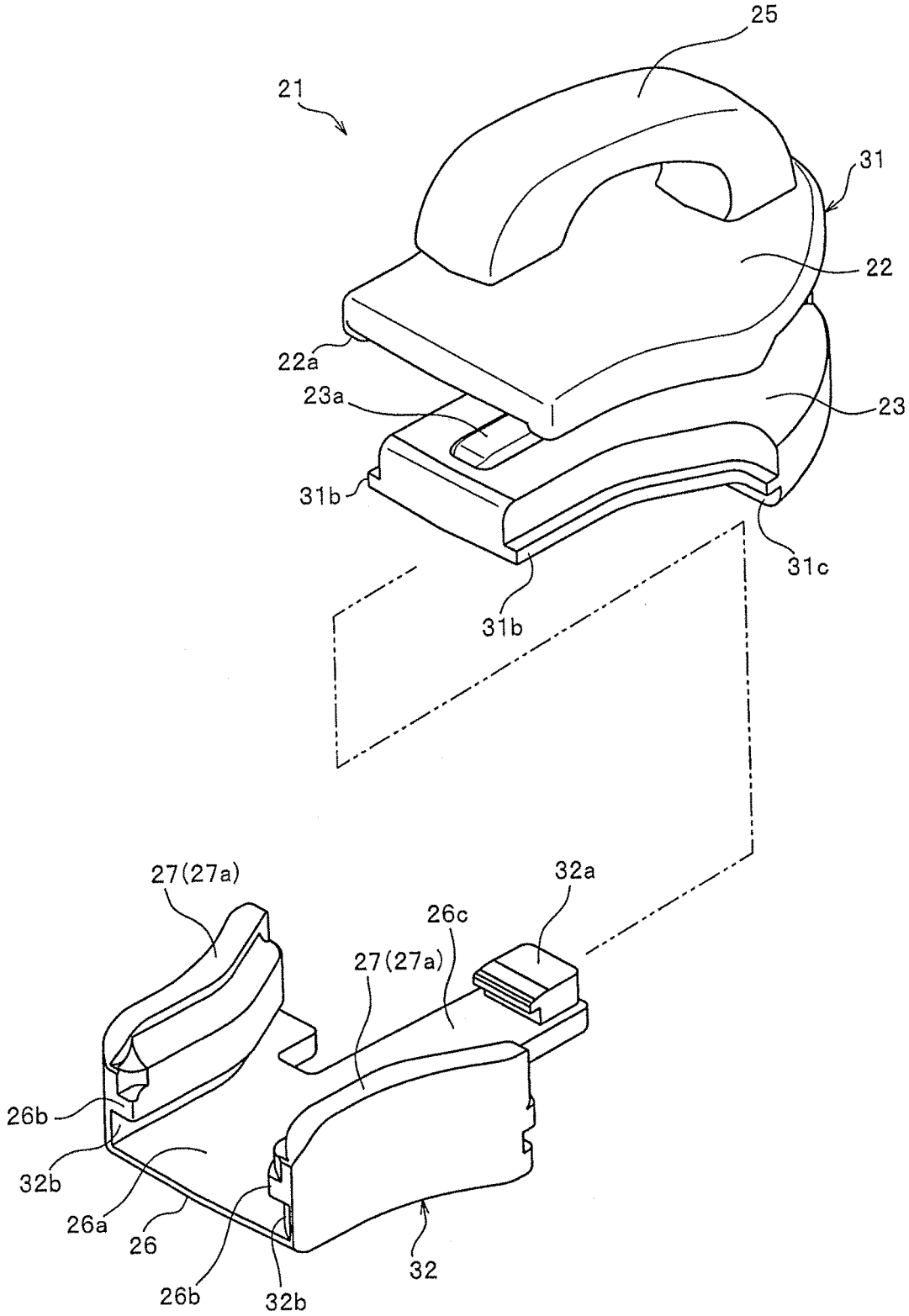
FIG. 11 is an exploded perspective view of the slider body disassembled into a first slider member and a second slider member.

As illustrated in FIG. 11, the slider body 21 of the first segmented slider 20 includes a first slider member 31 and a second slider member 32 which are capable of being assembled to each other. Of the members (i.e., upper blade 22, lower blade 23, and lower flange portion 27) that form an inner wall surface of the element guide passage 28 so as to allow insertion of the element rows 12 into the element guide passage 28 when the first and second slider members 31 and 32 are assembled, the upper blade 22 and lower blade 23 are included in the first slider member 31, and lower flange portion 27 is included in the second slider member 32.

In this case, the first slider member 31 includes the upper blade 22, lower blade 23, guide post 24, and tab attaching post 25 which constitute the slider body 21. Further, a concave-shaped first fitted portion (fit-in concave portion) 31*a* capable of receiving insertion of a part of the second slider member 32 for fitting is provided at the shoulder opening side end portion (front end portion) of the lower blade 23 of the first slider member 31. Further, a second fitted portion (projected rim portion) 31*b* is formed at the left and right side edge portions of the lower blade 23. The second fitted portion 31*b* projects in a slider width direction so as to allow a part of the second slider member 32 to be locked and fitted to the portion.

In particular, the second fitted portion 31*b* is disposed corresponding to the area where the lower flange portion 27 is provided in an assembled state of the slider body 21. Further, a positioning portion 31*c* projects downward from the lower surface side of the lower blade 23 so as to make front-rear direction positioning of the second slider member 32 with respect to the first slider member 31.

The second slider member 32 includes the base 26 and flange forming portions 27*a* integrally formed with the base 26 and constitute the left and right lower flange portions 27, respectively. In this case, the base 26 includes a base body 26*a* provided at the rear opening side end portion so as to bridge the left and right lower flange forming portions 27*a*. Further, the base 26 includes foundations 26*b* provided at left and right side edge portions of the base body 26*a*, respectively, so as to serve as foundations for the respective lower flange forming portions 27*a* and an extending portion 26*c* extending frontward (toward the shoulder opening side direction) from the base body 26*a* and is configured to be elastically deformable in the vertical direction. A front end edge of the base body 26*a* is formed into a shape corresponding to the positioning portion 31*c* provided on the lower surface of the lower blade 23 of the first slider member 31.

A first fitting portion (hook portion) 32*a* to be fitted in the first fitted portion (fit-in concave portion) 31*a* of the first slider member 31 is provided at a leading end of the extending portion 26*c*, and a concave groove shaped second fitting portion (concave groove portion) 32*b* to be fitted in the second fitted portion (projected rim portion) 31*b* of the first slider member 31 is provided in the left and right foundations 26*b*.

Figure 12:
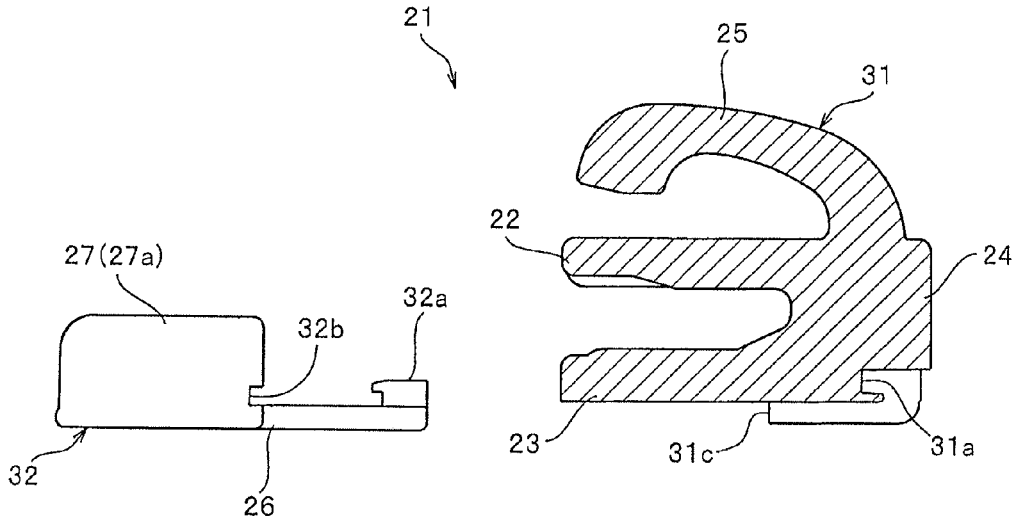
FIG. 12 is an explanatory view explaining a state where the first and second slider members are assembled.
Figure 13:
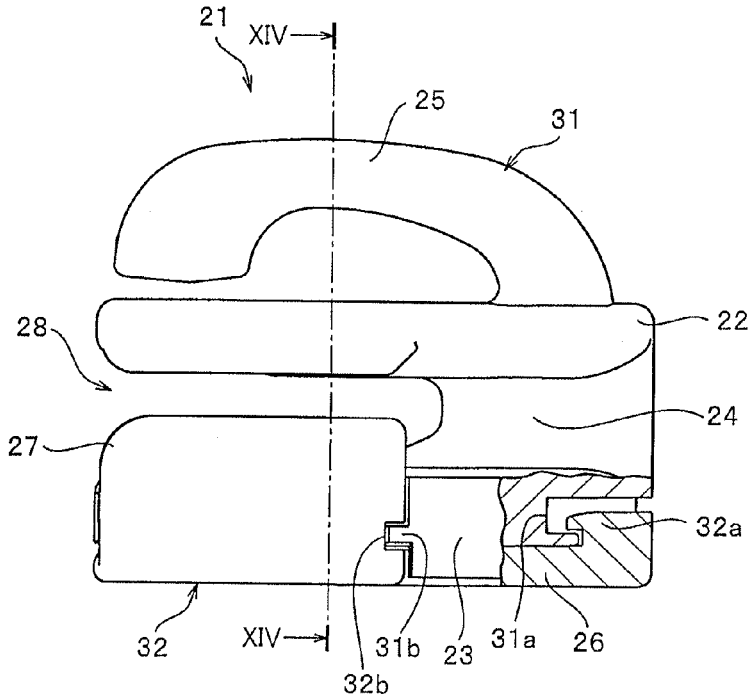
FIG. 13 is a partially cross-sectional view schematically illustrating the assembled slider body.

As illustrated in FIGS. 11 and 12, when the thus configured first and second slider members 31 and 32 are assembled to each other to form the first segmented slider 20, first the second fitting portion (concave groove portion) 32*b* of the second slider member 32 is fitted to the second fitted portion (projected rim portion) 31*b* of the first slider member 31 from the rear opening side. Then, the second slider member 32 is relatively slid toward the shoulder opening side of the first slider member 31 to fully fit the second fitting portion 32*b* of the of the second slider member 32 in the second fitted portion 31*b* of the first slider member 31.

At this time, the extending portion 26*c* of the second slider member 32 is elastically deformed so as to be curved downward, and the hook-like first fitting portion 32*a* is moved to the shoulder opening side end portion of the first slider member 31. Then, after the second fitting portion 32*b* of the second slider member 32 is fully fitted in the second fitted portion 31*b* of the first slider member 31, the second slider member 32 is forcibly pushed forward with respect to the first slider member 31, causing the hook-like first fitting portion 32*a* formed at the leading end portion of the extending portion 26*c* to be fitted in the first fitted portion 31*a* of the first slider member 31.

As described above, by fitting the first and second fitting portions 32*a* and 32*b* of the second slider member 32 in the first and second fitted portions 31*a* and 31*b* of the first slider member 31, respectively, the second slider member 32 is assembled to the first slider member 31 to thereby form the first segmented slider 20.

The upper and lower blades 22 and 23 are integrally formed with each other through the guide post 24 in the first slider member 31. In the thus configured first segmented slider 20, a dimensional error is unlikely to occur in an interval between the upper and lower blades 22 and 23, allowing the element guide passage 28 to stably have a predetermined height dimension. Thus, the left and right element rows 12 can be stably coupled/separated to/from each other when the first segmented slider 20 is slid to open/close the slide fastener 15.

In this first segmented slider 20, the whole lower blade 23 is provided in the first slider member 31, and the lower flange portion 27 corresponding to the lower blade 23 is provided in the second slider member 32. Thus, a boundary between the first and second slider members 31 and 32 is set between the lower blade 23 and lower flange portion 27 that constitute the element guide passage 28.

However, in the invention, the segmented slider may be configured as follows, for example: a part (inner portion) of the lower blade that constitutes the element guide passage is provided in the first slider member, and the remaining part (outside portion) of the lower blade that constitutes the element guide passage and the lower flange portion are provided in the second slider member as a flange forming portion. In this case, it may be configured that a boundary between the first and second slider members separates the lower blade.

In this case, preferably a size of a part of the lower blade that constitutes the element guide passage 28 which is integrally formed with the upper blade is larger than that of a part of the lower blade that constitutes the element guide passage 28 which is integrally formed with the flange forming portion side. Thus, by sliding the first segmented slider 20 to perform opening/closing of the slide fastener 15, the left and right element rows 12 can be stably coupled/separated to/from each other.

The "part of the lower blade that constitutes the element guide passage" refers to an inner surface constituting the element guide passage, and the "size" refers to a surface area of the inner surface.

By releasing the fitting between the first and second fitted portions 31*a* and 31*b* of the first slider member 31 and first and second fitting portions 32*a* and 32*b* of the second slider member 32, after the first segmented slider 20 is formed by fitting the second slider member 32 to the first slider member 31, the first segmented slider 20 can be separated once again into the first and second slider members 31 and 32.

Thus, the first segmented slider 20 is configured to be separably assembled, whereby if failure or breakage occurs in the first segmented slider 20 at the time of use of the slide fastener 15, the slide fastener 15 can be easily repaired by replacement of the slider.

The first segmented slider 20 having the thus configured first and second slider members 31 and 32 is attached to the fastener chain 10, as illustrated in FIGS. 6 and 7, in which the element rows 12 are partially separated.

Figure 14:
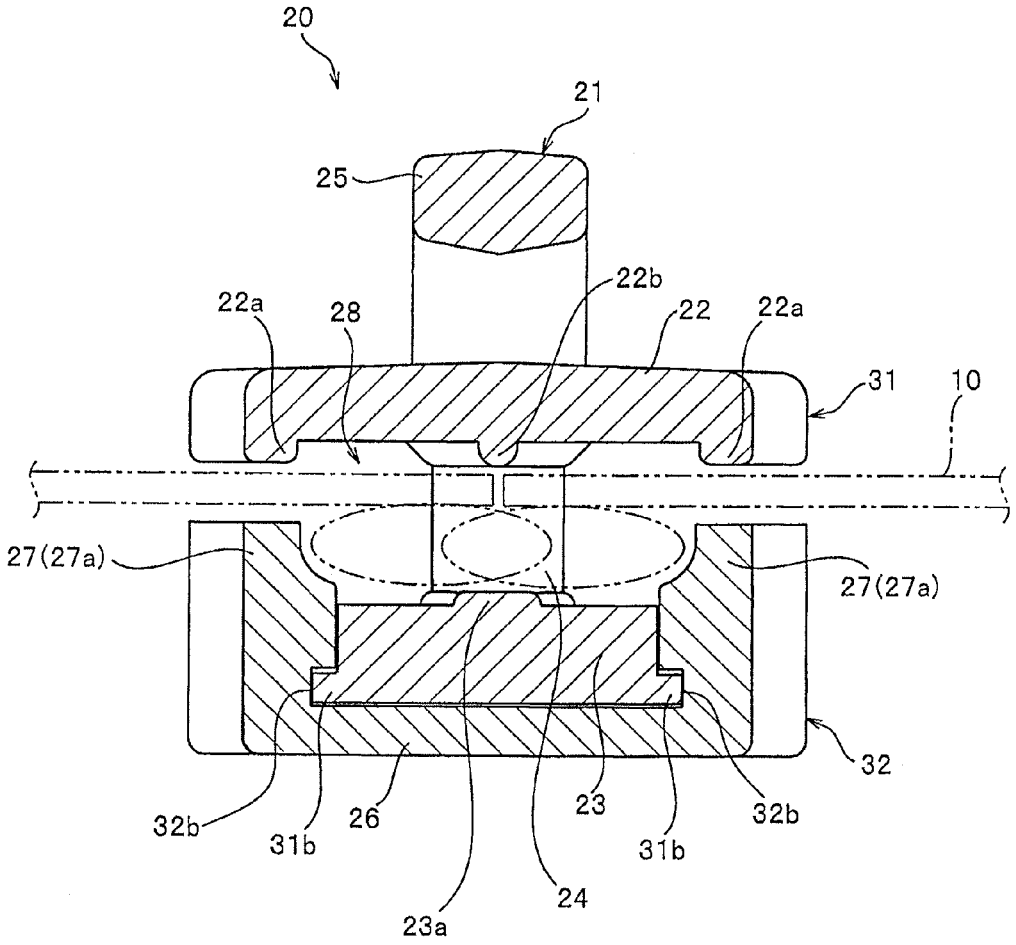
FIG. 14 is a cross-sectional view taken along a line XIV-XIV of FIG. 13.
Figure 15:
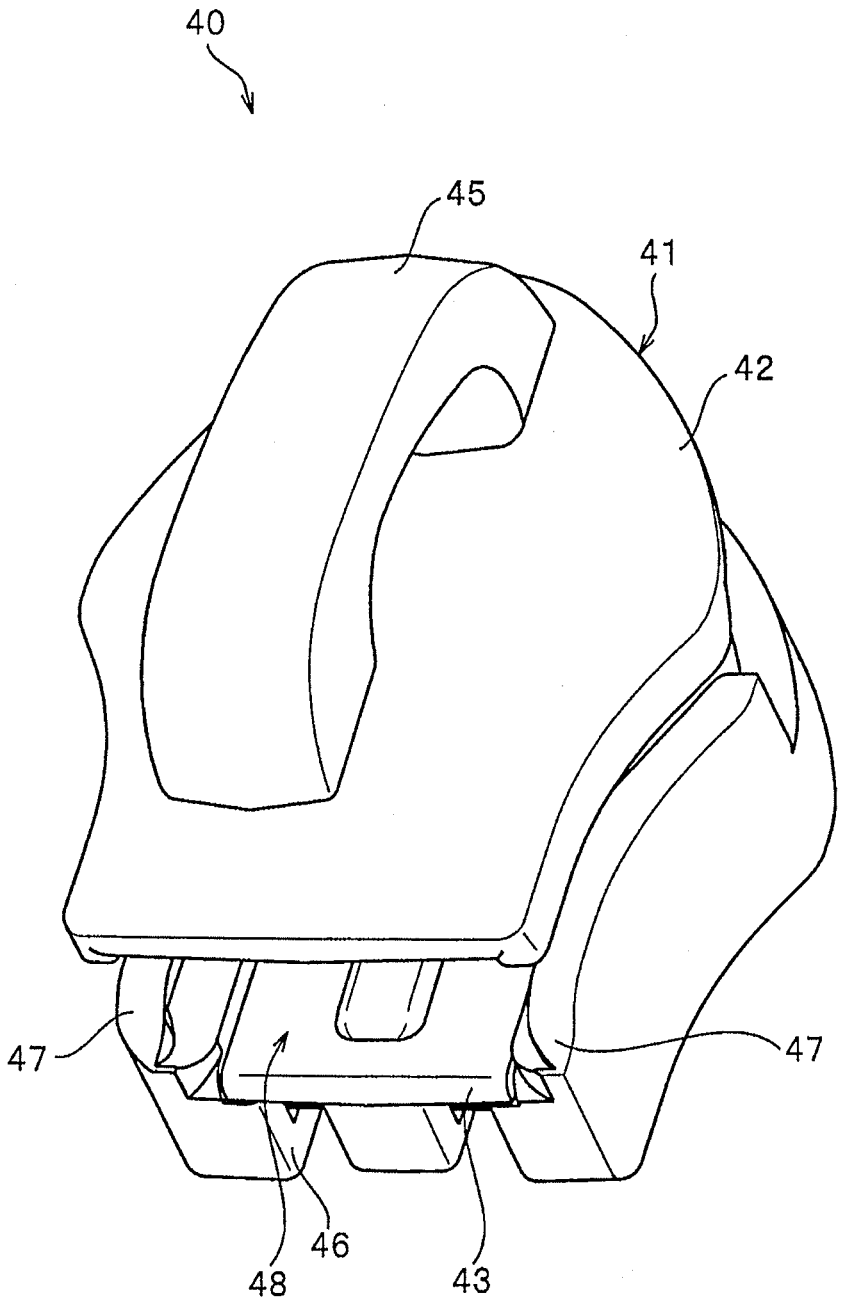
FIG. 15 is a perspective view illustrating a slider body of a second slider which is another example of the slider that can be attached to the element rows of the fastener chain.

Specifically, first the separated portion of the element rows 12 of the fastener chain 10 is inserted between the upper and lower blades 22 and 23 of the first slider member 31. Subsequently, as illustrated in FIGS. 11 and 12, the second slider member 32 is fitted to the first slider member 31 into which the element rows 12 have been inserted. As a result, as illustrated in FIG. 14, the first segmented slider 20 is formed by the first and second slider members 31 and 32 with the element rows inserted into the element guide passage 28.

Figure 8:
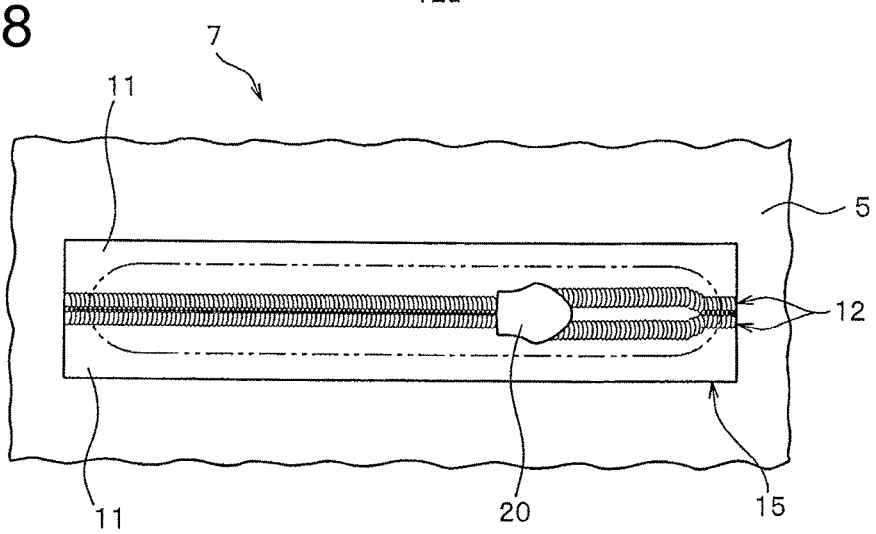
FIG. 8 is a bottom view illustrating a state where a slider is attached to the part where the element rows of the fastener chain are separated.
Figure 9:
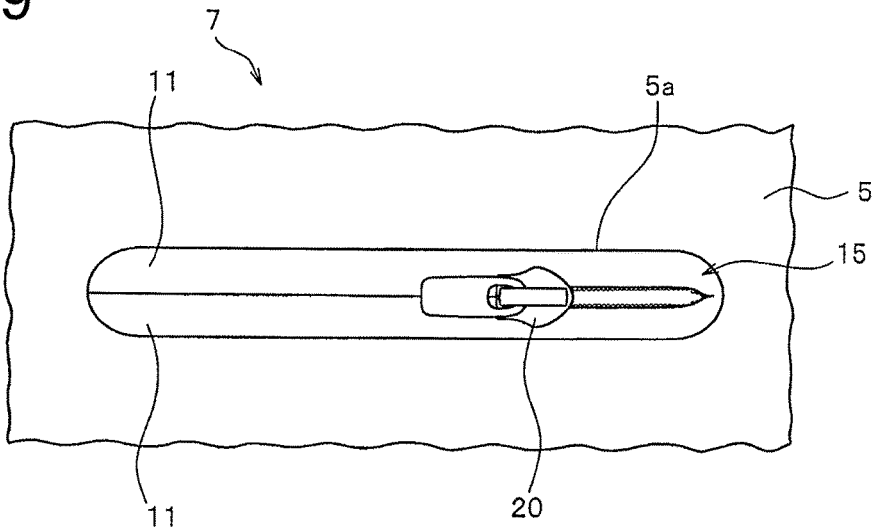
FIG. 9 is a plan view illustrating a state where the slider is attached to the part where the element rows of the fastener chain are separated.

By performing the processes described above, the product 7, as illustrated in FIGS. 8 and 9, in which the slide fastener 15 having the first segmented slider 20 slidably moved along the element rows 12 is attached, not by sewing but by welding, to the fastener receiving member 5 without sewing, can be obtained.

In the thus obtained product 7, the slide fastener 15 is attached to the fastener receiving member 5 without sewing, so that a thickness of an attachment portion of the slide fastener 15 can be made smaller than that in a product in which the slide fastener is attached by sewing, whereby a weight of the product 7 can be reduced. Further, since needle holes are not formed in the slide fastener 15 or fastener receiving member 5, the product 7 to which the slide fastener 15 is attached without sewing can be suitably used in the fields requiring, e.g., a waterproof property.

Further, in the product 7 produced in the first embodiment, only a single welding operation is required to attach the fastener chain 10 to the fastener receiving member 5. This improves efficiency of the attachment work of the slide fastener 15 and makes it unlikely to generate a reduction in the yield caused due to sparking upon welding, thereby allowing production cost to be reduced as compared to a conventional product.

Further, in the product 7, the welding is not performed a plurality of times while shifting the position, so that it is possible to prevent occurrence of a defect such as formation of a stepped portion in the welding portion between the slide fastener 15 and fastener receiving member 5 or a change in color of the welding portion, which can make appearance of the product 7 satisfactory.

In the first embodiment, the first segmented slider 20 illustrated in FIGS. 10 to 14 is attached to the element rows 12 of the fastener chain 10 welded to the fastener receiving member 5; however, in the invention, the slider to be attached to the element rows 12 is not limited to the first segmented slider 20, but other segmented sliders such as second to fourth segmented sliders 40 to 80 to be described below may be used.

The second to fourth segmented sliders 40 to 80 will be described in detail with reference to the drawings.

First, as illustrated in FIGS. 15 to 18, the second segmented slider 40 includes a slider body 41 and a not illustrated tab rotatably retained by the slider body 41. The slider body 41 includes an upper blade (first blade) 42, a lower blade (second blade) 43, a guide post 44 connecting shoulder opening side end portions of the respective upper and lower blades 42 and 43, a tab attaching post 45 provided on an upper surface side of the upper blade 42, a base 46 fitted to a lower surface side of the lower blade 43, and a lower flange portion 47 provided along left and right side edge portions of the lower blade 43.

The slider body 41 of the second segmented slider 40 includes a first slider member 51 and a second slider member 52 which are capable of being assembled to each other. Of the members that form an element guide passage 48 so as to allow insertion of the element rows 12 into the element guide passage 48 when the first and second slider members 51 and 52 are assembled, the upper blade 42 and lower blade 43 are included in the first slider member 51, and lower flange portion 47 is included in the second slider member 52.

In this case, the first slider member 51 includes the upper blade 42, lower blade 43, guide post 44, and tab attaching post 45 which constitute the slider body 41. Further, a concave-shaped first fitted portion (fit-in concave portion) 51*a* and a second fitted portion (fit-in concave portion) 51*b* which are capable of receiving insertion of a part of the second slider member 52 for fitting are provided respectively at the shoulder opening side end portion (front end portion) and rear opening side end portion (rear end portion) of the lower blade 43 of the first slider member 51.

The second slider member 52 includes the base 46 and a flange forming portions 47*a* integrally formed with the base 46 and constitute the left and right lower flange portions 47, respectively. In this case, the base 46 includes a base body 46*a* having substantially the same shape as that of the lower blade 43 in a plan view and foundations 46*b* provided at left and right side edge portions of the base body 46*a*, respectively, so as to serve as foundations for the respective lower flange forming portions 47*a*.

Further, a hook-like first fitting portion (hook portion) 52*a* to be fitted in the first fitted portion 51*a* of the first slider member 51 provided at the front end portion of the first slider member 51 is erected at a front end of the base body 46*a*. Further, a pair of left and right cut portions extending frontward from a rear end of the base body 46*a* are provided at a rear end portion of the base body 46*a*, and a tongue piece portion 46*c* is formed between the pair of cut portions so as to be elastically deformable. Further, a hook-like second fitting portion 52*b* to be fitted in the second fitted portion 51*b* on the rear end portion side of the first slider member 51 is erected at a rear end portion of the tongue piece portion 46*c*.

Figure 17:
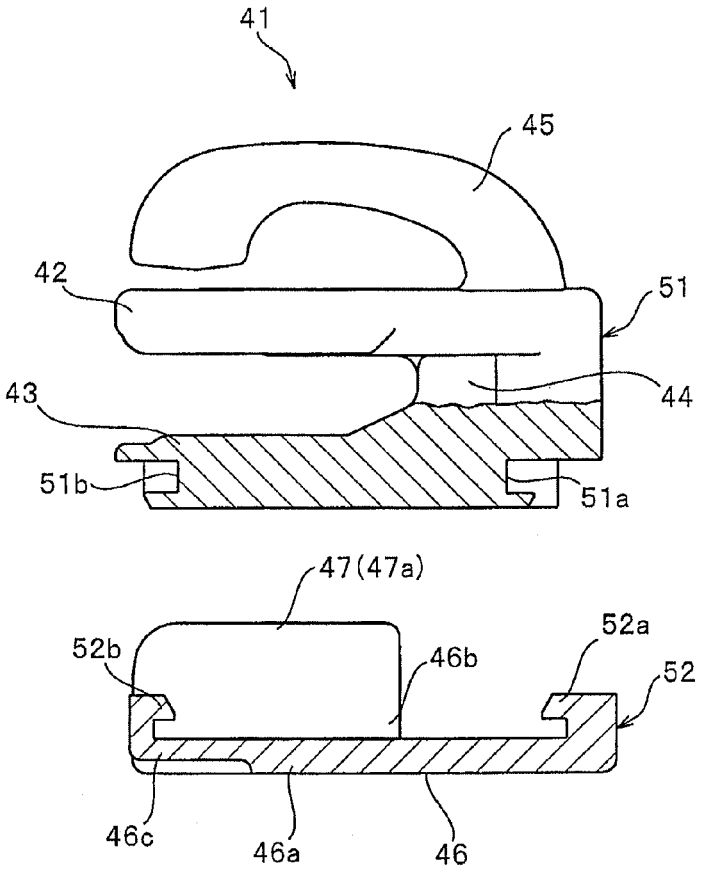
FIG. 17 is an explanatory view explaining a state where the first and second slider members are assembled.
Figure 18:
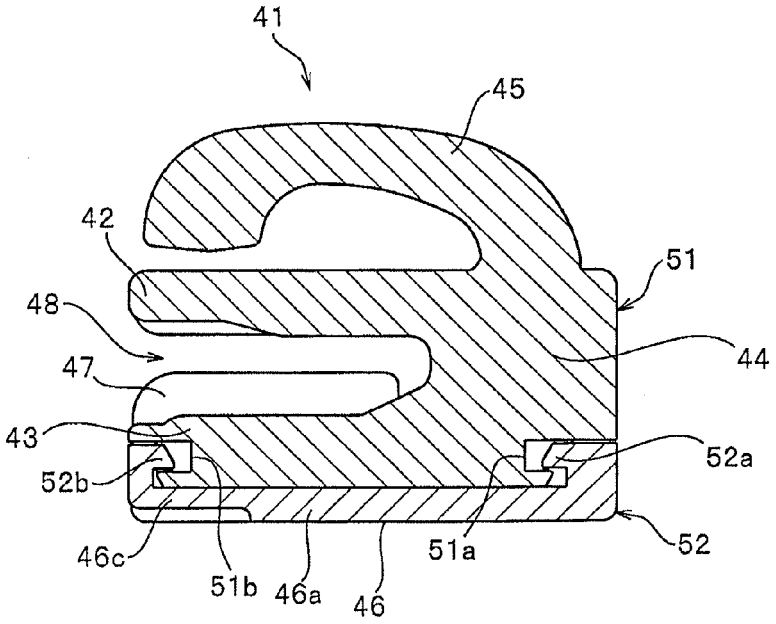
FIG. 18 is a cross-sectional view illustrating the assembled slider body.
Figure 19:
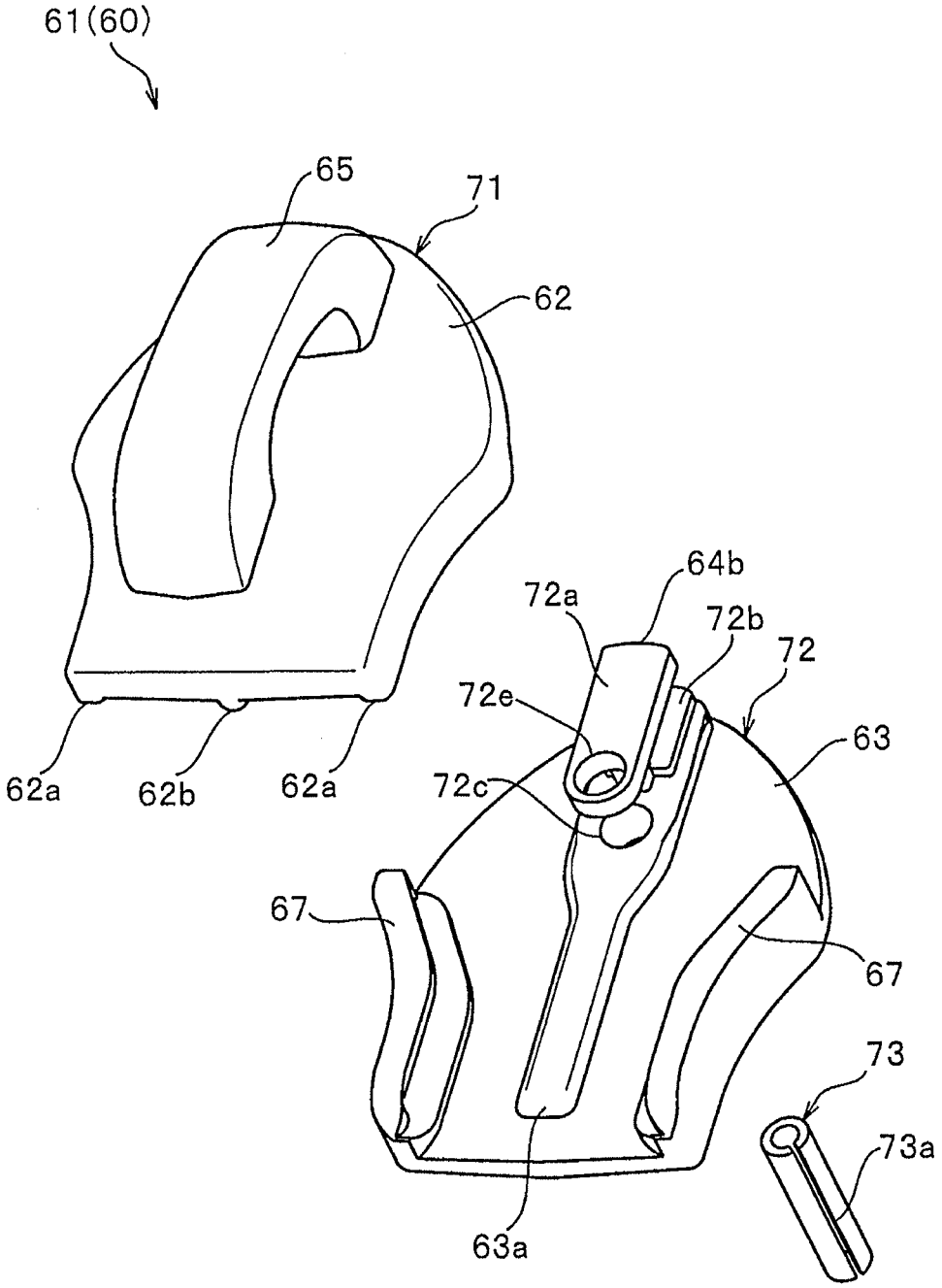
FIG. 19 is an exploded perspective view illustrating a state where a slider body of a third slider which is still another example of the slider that can be attached to the element rows of the fastener chain.

In this case, as illustrated in FIG. 17, in order to assist the fitting of the first and second fitting portions 52*a* and 52*b* in the respective first and second fitted portions 51*a* and 51*b* of the first slider member 51 when the second slider member 52 is assembled to the first slider member 51, slopes for guiding the respective first and second fitting portions 52*a* and 52*b* of the second slider member 52 are formed at lower surface side leading end portions of the respective first and second fitted portions 51*a* and 51*b* of the first slider member 51. Further, for the same purpose, at respective leading end portions of the first and second fitting portions 52*a* and 52*b* of the second slider member 52, slopes inclined downward toward the leading end portions are formed.

Figure 16:
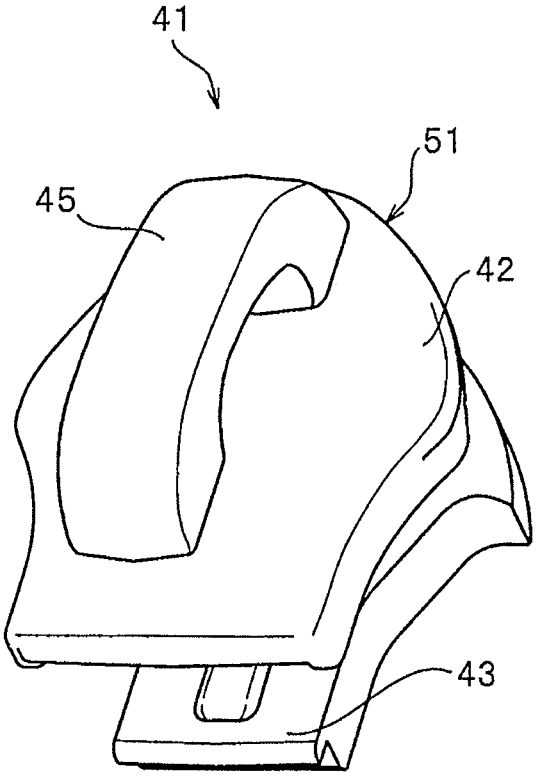
FIG. 16 is an exploded perspective view of the slider body disassembled into a first slider member and a second slider member.
Figure 16:
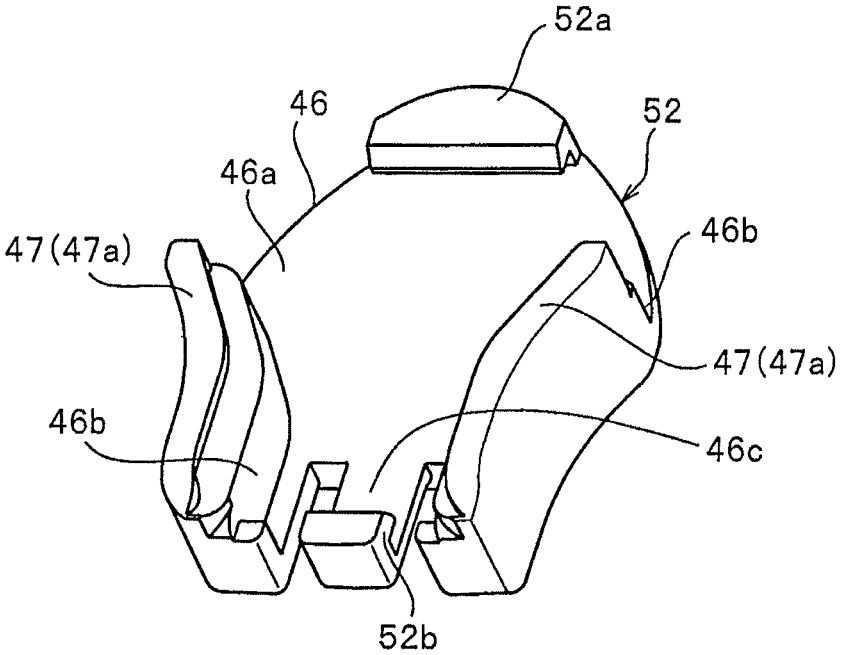

As illustrated in FIG. 16, when the thus configured first and second slider members 51 and 52 are assembled to form the second segmented slider 40, the second slider member 52 is brought close to the lower side of the first slider member 51 and pushed toward the first slider member 51. As a result, the first and second fitting portions 52*a* and 52*b* of the second slider member 52 are inserted and fitted in the first and second fitted portions 51*a* and 51*b* of the first slider member 51, respectively, with the base 46 of the second slider member 52 partially elastically deformed. By assembling the second slider member 52 to the first slider member 51 in this manner, the second segmented slider 40 can be obtained.

In the second segmented slider 40, as in the above-described first segmented slider 20, the upper and lower blades 42 and 43 of the first slider member 51 are integrally formed through the guide post 44, so that the element guide passage 48 stably has a predetermined height dimension. Thus, the left and right element rows 12 can be stably coupled/separated to/from each other when the second segmented slider 40 is slid to open/close the slide fastener 15.

In the second segmented slider 40, as in the above-described first segmented slider 20, a boundary between the first and second slider members 51 and 52 is set between the lower blade 43 and lower flange portion 47 that constitute the element guide passage 48. However, in the invention, the segmented slider may be configured as follows: a part (inner portion) of the lower blade is provided in the first slider member, and the remaining part (outside portion) of the lower blade and the lower flange portion are provided in the second slider member as a flange forming portion. In this case, it may be configured that a boundary between the first and second slider members separates the lower blade.

In this case, preferably a size of a part of the lower blade that constitutes the element guide passage 48 which is integrally formed with the upper blade side is larger than that of a part of the lower blade that constitutes the element guide passage 48 which is integrally formed with the flange forming portion side. Thus, by sliding the second segmented slider 40 to perform opening/closing of the slide fastener 15, the left and right element rows 12 can be stably coupled/separated to/from each other.

Further, after the second segmented slider 40 is formed by fitting the second slider member 52 to the first slider member 51, the second segmented slider 40 can be separated once again into the first and second slider members 51 and 52. Thus, if failure or breakage occurs in the second segmented slider 40 at the time of use of the slide fastener 15, the slider can be easily replaced.

Next, a third segmented slider 60 will be described with reference to FIGS. 19 to 23.

The third segmented slider 60 includes a slider body 61 and a tab not illustrated, rotatably retained by the slider body 61. The slider body 61 includes a first slider member 71 constituting an upper half part of the slider body 61, a second slider member 72 constituting a lower half of the slider body 61, and a split pin member 73 for fixing the first and second slider members 71 and 72 while retaining a fitting state therebetween.

Figure 20:
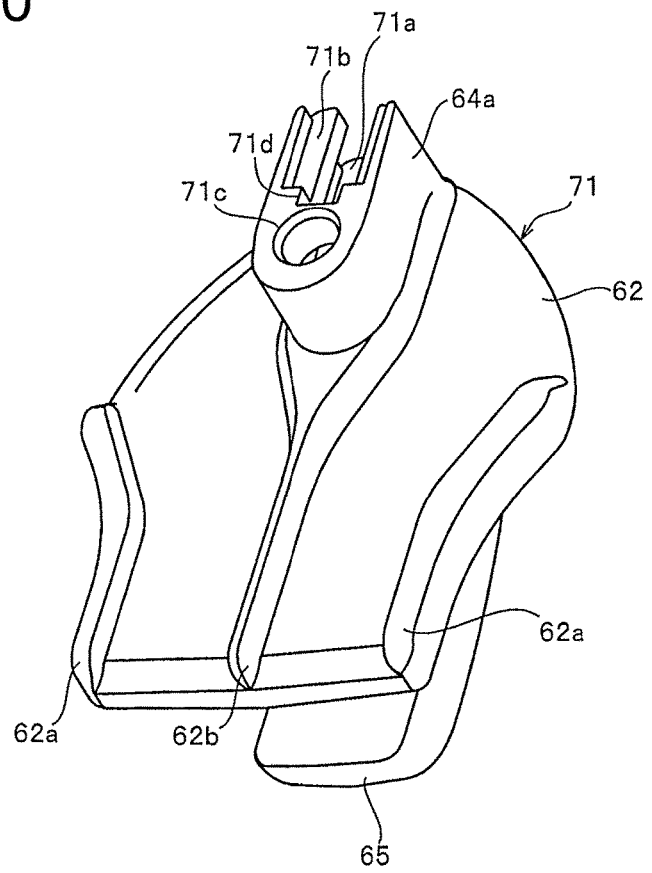
FIG. 20 is a perspective view of a first slider member of the slider body as viewed from an element guide passage side.

The first slider member 71 includes an upper blade 62, a first guide post 64*a* vertically installed at a front end portion (shoulder opening side end portion) of the upper blade 62, and a tab attaching post 65 provided on an upper surface side of the upper blade 62. Further, as illustrated in FIG. 20, in the first guide post 64*a*, an insertion hole portion 71*c* into which the split pin member 73 is inserted is formed in the vertical direction (slider height direction). Further, in the first guide post 64*a*, an upper end portion side first fitted portion (dovetail groove portion) 71*a* and a lower end portion side second fitted portion (recess) 71*b* are formed for fitting of a part (first and second fitting portions 72*a* and 72*b*) of a second guide post 64*b* (to be described later) of the second slider member 72. Further, an insertion groove portion 71*d* for inserting therethrough a post body 72*d* to be described later of the second guide post 64*b* is formed in the tongue piece portion between the first and second fitted portions 71*a* and 71*b* and a rear end portion of the second fitted portion 71*b*.

In this case, the first fitted portion 71*a* is drilled at an upper end portion of the first guide post 64*a* so as to extend rearward from a leading end of the first guide post 64*a* and so as to have a predetermined height dimension. Further, the first fitted portion 71*a* extends rearward of a formation position of the insertion hole portion 71*c* so as to cross the insertion hole portion 71*c*. The second fitted portion 71*b* is formed so as to be concave at a lower end portion of the first guide post 64*a* and is disposed forward of the insertion hole portion 71*c*.

Further, a first bulge portion 62*a* and a second bulge portion 62*b* are formed on a lower surface of the upper blade 62 of the slider member 71 in order to prevent an increase in sliding resistance due to sliding contact of the fastener tape 11 over the entire lower surface of the upper blade 62. The first bulge portion 62*a* is provided along left and right side edge portions of the lower surface of the upper blade 62, and the second bulge portion 62*b* is provided at a center of the lower surface of the upper blade 62 so as to extend from the first guide post 64*a* to a rear end portion (rear opening side end portion).

The second slider member 72 includes a lower blade 63, a second guide post 64*b* erected at a front end portion (shoulder opening side end portion) of the lower blade 63, and left and right lower flange portions 67 provided at respective left and right side edge portions of the lower blade 63. Further, an insertion hole portion 72*c* into which the split pin member 73 is inserted is formed at the front end portion of the lower blade 63 so as to penetrate the lower blade 63 from a lower surface to an upper surface of the lower blade 63. Further, a third bulge portion 63*a* for guiding the fastener elements 13 is formed on the upper surface of the lower blade 63 so as to extend rearward from the second guide post 64*b*.

The second guide post 64*b* includes a post body 72*d* erected from the lower blade 63, a first fitting portion 72*a* provided at an upper end of the post body 72*d* so as to be fitted in the first fitted portion 71*a* of the first slider member 71, and a second fitting portion 72*b* provided at a base end of the post body 72*d* so as to be fitted in the second fitted portion 71*b* of the first slider member 71. In this case, the first fitting portion 72*a* is formed into a flat plate-like shape so as to project toward the left and right side edges and rear side of the post body 72*d*, and an insertion hole portion 72*e* into which the split pin member 73 is inserted is drilled at a rear end portion of the first fitting portion 72*a*.

The split pin member 73 is formed into a cylindrical shape. Further, the split pin member 73 has a linear slit 73*a* formed along a length direction thereof. When the split pin member 73 is pressed in a direction narrowing the slit 73*a*, it can be elastically deformed so as to be reduced in diameter.

Figure 21:
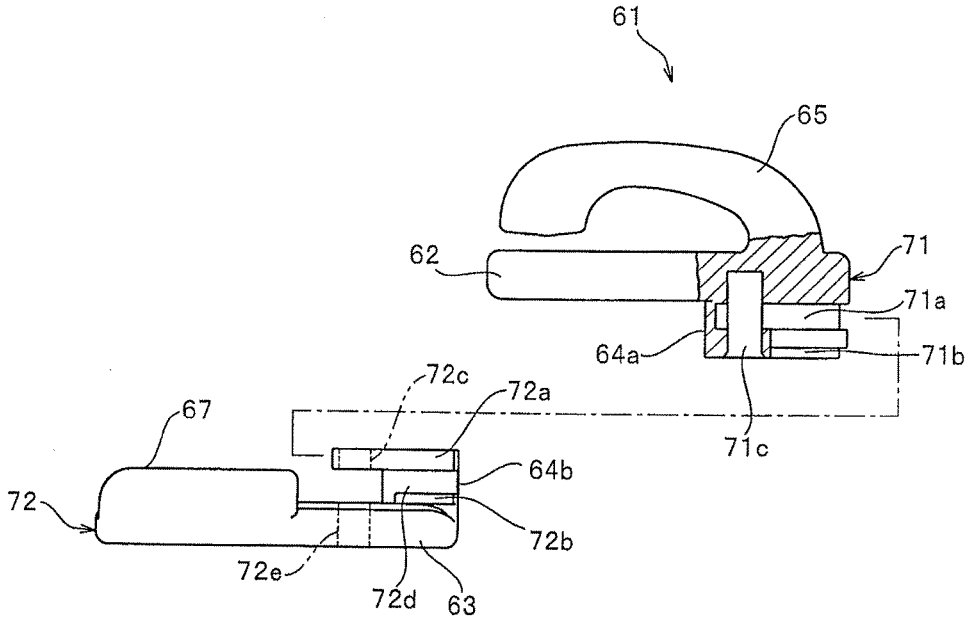
FIG. 21 is an explanatory view explaining a state where the first and second slider members of the slider body are assembled.
Figure 22:
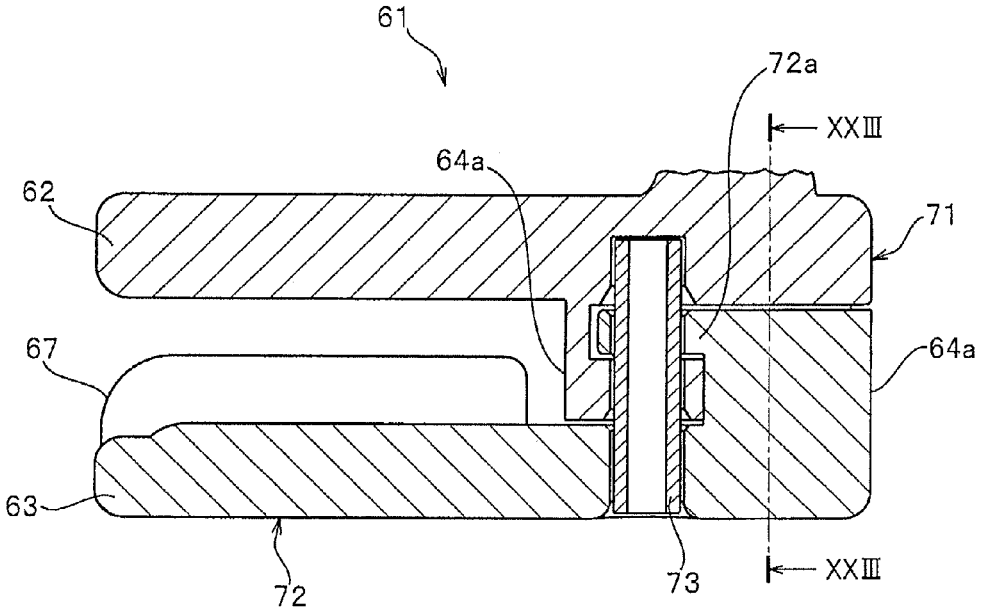
FIG. 22 is a cross-sectional view of a part of the assembled slider body.
Figure 23:
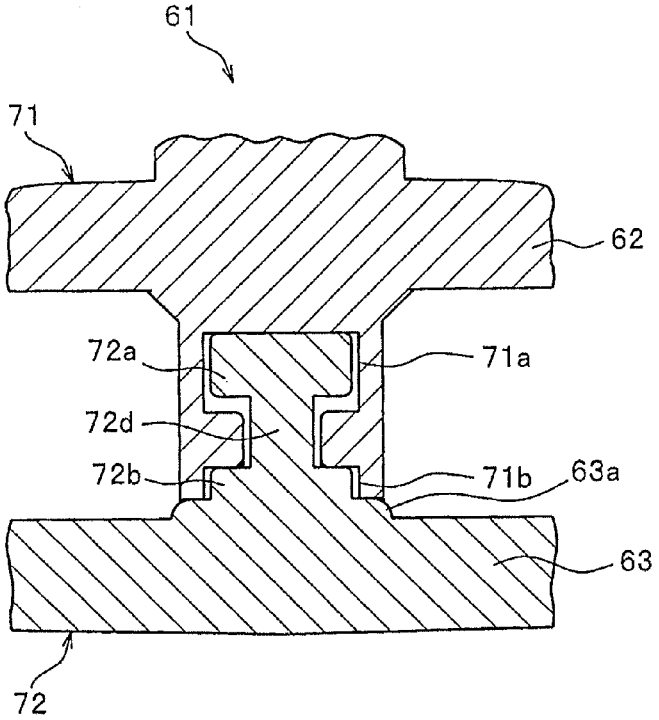
FIG. 23 is a cross-sectional view taken along a line XXIII-XXIII of FIG. 22.

When the thus configured first slider member 71, second slider member 72, and split pin member 73 are assembled to form the third segmented slider 60, first, as illustrated in FIG. 21, the second slider member 72 is inserted into the first slider member 71 with the rear side of the second slider member 72 facing the front side of the first slider member 71, to thereby assemble the second guide post 64*b* of the second slider member 72 to the first guide post 64*a* of the first slider member 71.

At this time, the first and second fitting portion 72*a* and 72*b* of the second slider member 72 are inserted and fitted in the respective first and second fitted portions 71*a* and 71*b* of the first slider member 71, and a position of the insertion hole portion 71*c* formed in the first guide post 64*a* of the first slider member 71 and positions of the insertion hole portions 72*c* and 72*e* formed in the respective lower blade 63 and first fitting portion 72*a* of the second slider member 72 are aligned with each other. As a result, the first and second slider members 71 and 72 can be fixed with their mutual relative positions aligned.

Subsequently, the split pin member 73 in a state being pressed so as to be reduced in diameter is inserted deeply into the insertion hole portion 71*c* formed in the first slider member 71 from the insertion hole portion 72*c* formed in the lower blade 63 of the second slider member 72. After that, when the pressing applied to the split pin member 73 is released, it elastically returns to its original shape and is brought into press contact with an inner surface of the insertion hole portion 71*c* of the first slider member 71 and inner surfaces of the insertion hole portions 72*c* and 72*e* of the second slider member 72. Thus, the fitting state between the first and second slider members 71 and 72 is retained by the split pin member 73, whereby the assembly of the third segmented slider 60 is completed.

Figure 24:
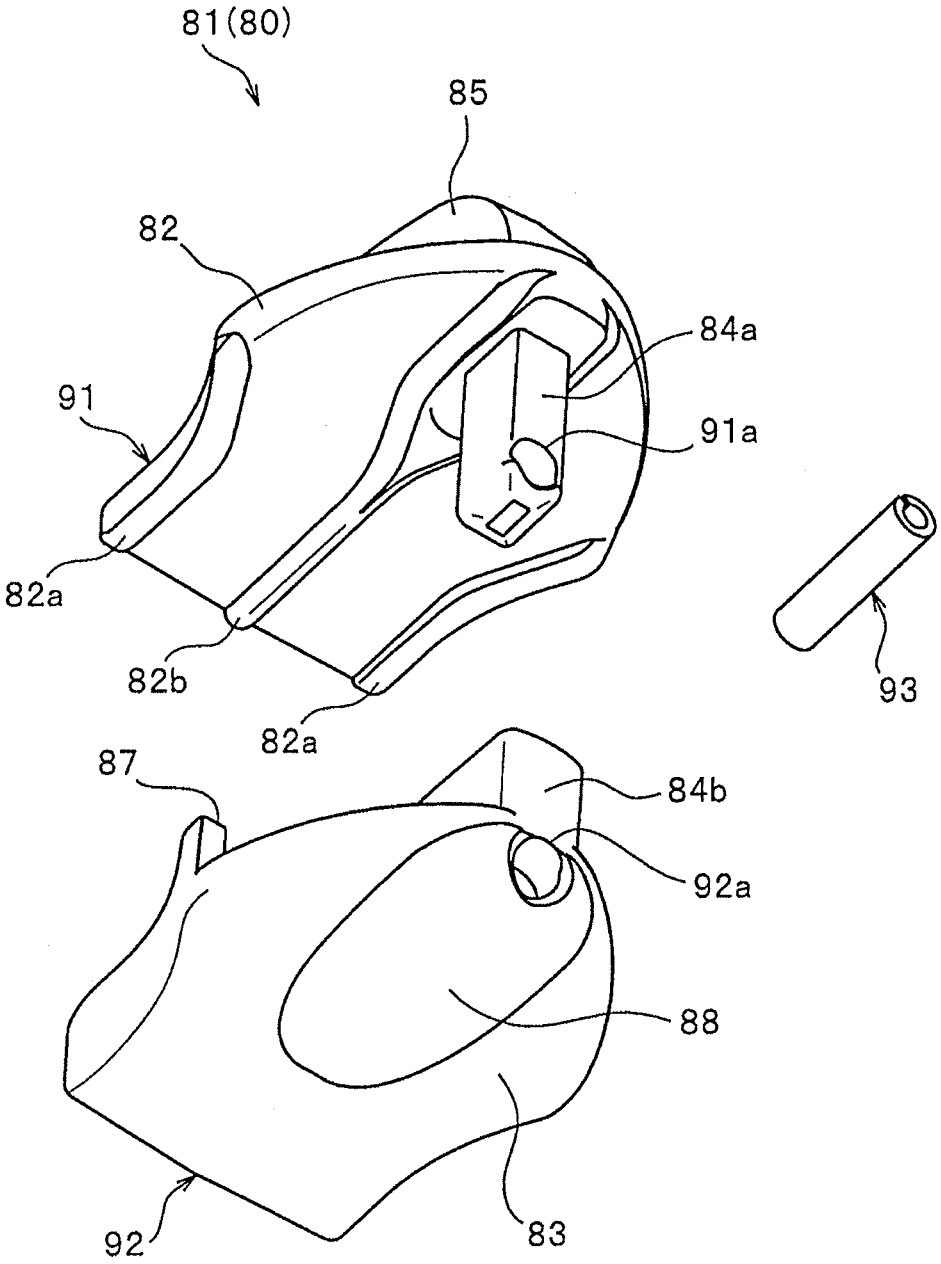
FIG. 24 is an exploded perspective view illustrating a state where a slider body of a fourth slider which is still another example of the slider that can be attached to the element rows of the fastener chain.
Figure 25:
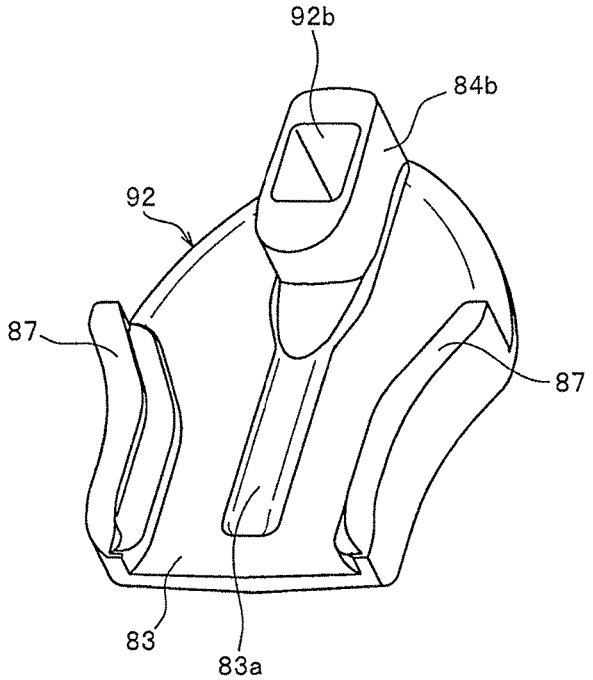
FIG. 25 is a perspective view of a first slider member of the slider body as viewed from an element guide passage side.

Next, a fourth segmented slider 80 will be described with reference to FIGS. 24 to 26.

The fourth segmented slider 80 includes a slider body 81 and a tab not illustrated, rotatably retained by the slider body 81.

The slider body 81 includes a first slider member 91 constituting an upper half part of the slider body 81, a second slider member 92 constituting a lower half of the slider body 81, and a split pin member 93 for fixing the first and second slider members 91 and 92 while retaining a fitting state therebetween. The split pin member 93 has the same configuration as that of the split pin member 73 used for the third segmented slider 60.

The first slider member 91 includes an upper blade 82, a first guidepost 84*a* vertically installed at a front end portion (shoulder opening side end portion) of the upper blade 82, and a tab attaching post 85 provided on an upper surface side of the upper blade 82. Further, at a lower end portion of the first guide post 84*a*, an insertion hole portion 91*a* into which the split pin member 93 is inserted is formed in the front-rear direction (slider sliding direction). Further, a first bulge portion 82*a* and a second bulge portion 82*b* are formed on a lower surface of the upper blade 82 of the slider member 91 in order to prevent an increase in sliding resistance due to sliding contact of the fastener tape 11 over the entire lower surface of the upper blade 82. The first bulge portion 82*a* is provided along left and right side edge portions of the lower surface of the upper blade 82, and the second bulge portion 82*b* is provided at a center of the lower surface of the upper blade 82 so as to extend from the first guide post 84*a* to a rear end portion (rear opening side end portion).

The second slider member 92 includes a lower blade 83, a second guide post 84*b* erected at a front end portion (shoulder opening side end portion) of the lower blade 83, left and right lower flange portions 87 provided at respective left and right side edge portions of the lower blade 83, and a swelling portion 88 formed so as to swell downward from a front end portion of a lower surface of the lower blade 83. Further, a third bulge portion 83*a* for guiding the fastener elements 13 is formed on the upper surface of the lower blade 83 so as to extend rearward from the second guide post 84*b*.

An insertion hole portion 92*a* into which the split pin member 93 is inserted is drilled in the lower blade 83 and swelling portion 88 of the second slider member 92 so as to extend rearward in the front-rear direction (slider sliding direction) from a front end portion of the swelling portion 88.

Further, a post insertion hole portion 92*b* into which the first guide post 84*a* of the first slider member 91 is inserted is drilled in the second guide post 84*b* so as to extend downward in the up-down direction (slider height direction) from an upper surface of the second guide post 84*b*. The post insertion hole portion 92*b* has a shape corresponding to the first guide post 84*a* and extends downward of a formation position of the insertion hole portion 92*a* so as to cross the insertion hole portion 92*a* of the split pin member 93.

Figure 26:
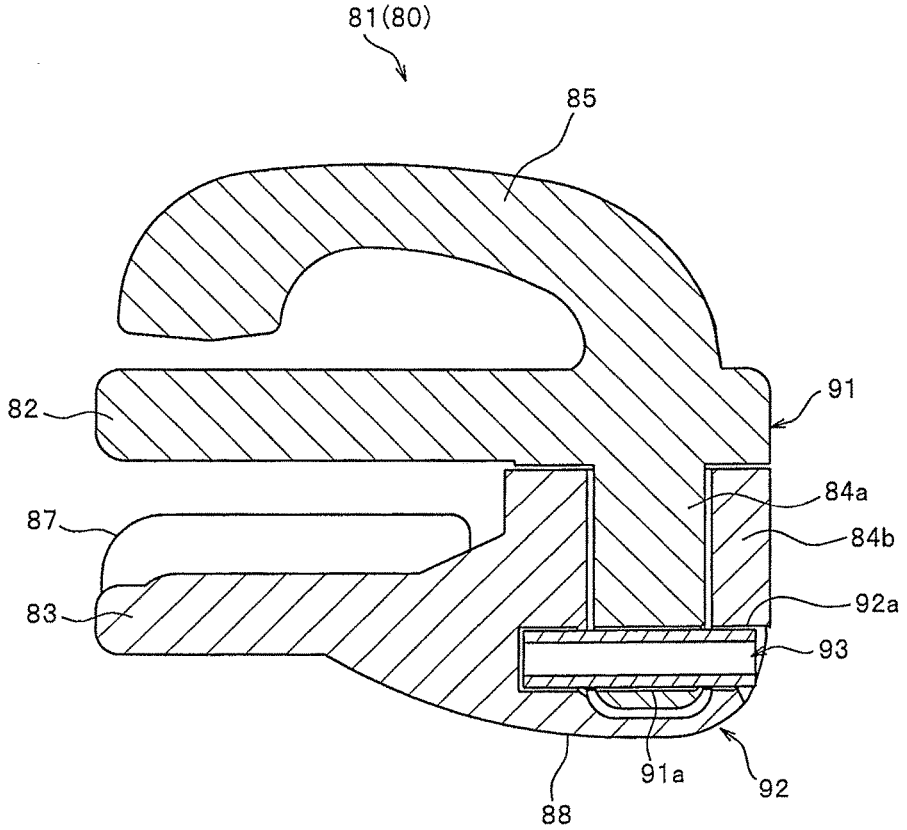
FIG. 26 is a cross-sectional view of the assembled slider body.

When the thus configured first slider member 91, second slider member 92, and split pin member 93 are assembled to form the fourth segmented slider 80, first, as illustrated in FIG. 26, the first guide post 84*a* of the first slider member 91 is inserted and fitted in the post insertion hole portion 92*b* formed in the second guide post 84*b* of the second slider member 92, and a position of the insertion hole portion 91*a* formed in the first guide post 84*a* and position of the insertion hole portion 92*a* formed in the second slider member 92 are aligned with each other.

Subsequently, the split pin member 93 in a state being pressed so as to be reduced in diameter is inserted so as to bridge the insertion hole portion 92*a* formed in the second slider member 92 and insertion hole portion 91*a* formed in the first slider member 91. After that, when the pressing applied to the split pin member 93 is released, it elastically returns to its original shape and is brought into press contact with inner surfaces of the insertion hole portions 91*a* and 92*a* of the respective first and second slider members 91 and 92. Thus, the fitting state between the first and second slider members 91 and 92 is retained by the split pin member 93, whereby the assembly of the fourth segmented slider 80 is completed.

In the first embodiment, the second to fourth segmented sliders 40 to 80 as described above can be used in place of the above-described first segmented slider 20. That is, by assembling the second segmented slider 40, third segmented slider 60, or fourth segmented slider 80 and attaching it to the element rows 12 of the fastener chain 10 welded to the fastener receiving member 5 as illustrated in FIGS. 6 and 7, the slide fastener 15 can be obtained.

The configuration of the slider according to the invention is not limited to those of the above-described first to fourth segmented sliders 20, 40, 60, and 80. For example, the fourth segmented slider 80 may have a configuration in which the split pin member 93 is not used. In this case, the first guide post 84*a* of the first slider member 91 is inserted and fitted in the post insertion hole portion 92*b* formed in the second guide post 84*b* of the second slider member 92 and then firmly bonded or welded to the post insertion hole portion 92*b*.

Further, in the first embodiment, the number of the slider members constituting the slider element is two; however, it is possible to use three or more slider members to constitute the segmented slider as long as the segmented slider can be attached to the element rows 12 after the fastener chain 10 is attached to the fastener receiving member 5.

Second Embodiment

Figure 27:
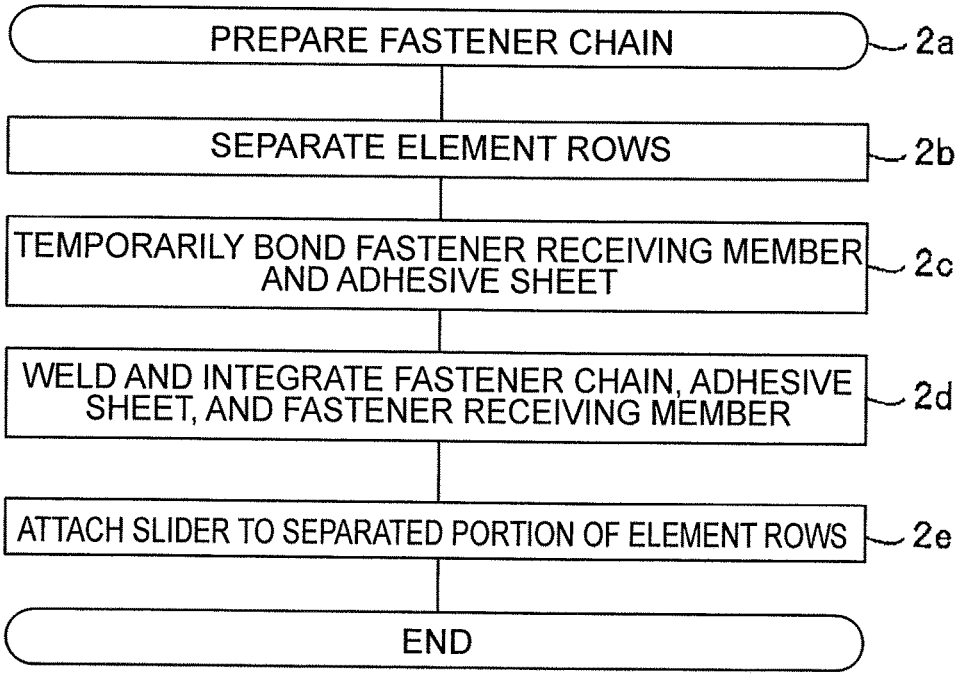
FIG. 27 is a flowchart illustrating a slide fastener attachment method according to a second embodiment of the invention.
Figure 28:
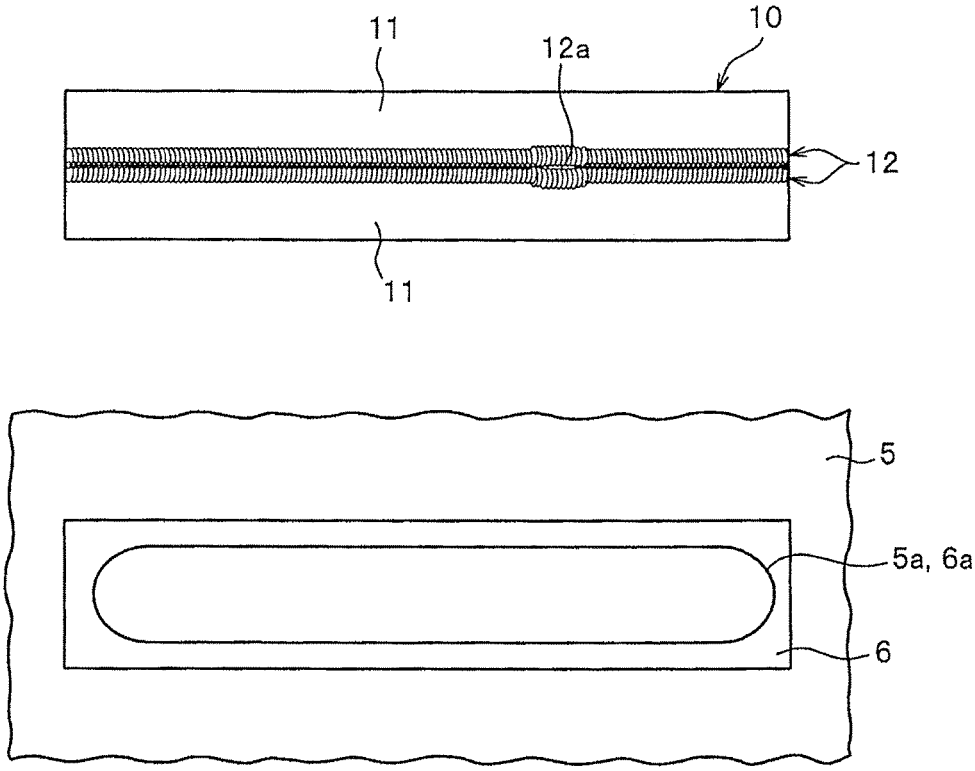
FIG. 28 is a schematic view illustrating a relationship between the fastener chain before welding and temporarily bonded adhesive film and fastener receiving member.

FIG. 27 is a flowchart illustrating a slide fastener attachment method according to a second embodiment of the invention. FIG. 28 is a schematic view illustrating a relationship between the fastener chain before welding and temporarily bonded adhesive film and fastener receiving member.

In the attachment method according to the second embodiment, a fastener chain 10 for a slide fastener 15 to be attached is prepared and, a slider (first segmented slider) 20 to be attached to the fastener chain 10 is prepared separately from the fastener chain 10 (step 2*a* of FIG. 27).

In this case, the fastener chain 10 itself has substantially the same configuration as that of the fastener chain 10 prepared in the attachment method according to the first embodiment; however, in the second embodiment, the left and right element rows 12 of the fastener chain 10 coupled to each other over the entire length of the rows are partially separated, as illustrated in FIG. 28, manually or using the element separating member 8 described in the first embodiment before the welding (step 2*b* of FIG. 27).

Any position may be selected as the position at which the element rows 12 are separated from each other as long as it exists within the area between the stopping tools of the element rows 12. Further, in the second embodiment, it is possible to form a fragile portion 14 formed in a part of the element rows 12 by the weakly coupled element 13*a* from which the coupling head is cut off to make it easy to partially separate the left and right element rows 12 of the fastener chain 10.

Along with preparation of the thus configured fastener chain 10, the fastener receiving member 5 to which the fastener chain 10 is attached and an adhesive film 6 disposed between the fastener chain 10 and fastener receiving member 5 are prepared. The fastener receiving member 5 and adhesive film 6 prepared in the second embodiment are the same as those prepared in the first embodiment.

In the second embodiment, before the fastener chain 10 is welded to the fastener receiving member 5, the prepared adhesive film 6 is previously temporarily bonded (fixed) using an iron to a surface (lower surface) of the fastener receiving member 5 on which the fastener chain 10 is welded (step 2*c* of FIG. 27).

Then, welding is performed in a state where the fastener chain 10 in which the element rows 12 have been partially separated and fastener receiving member 5 to which the adhesive film 6 has been temporarily bonded are put one over the other (step 2*d* of FIG. 27). Also in the second embodiment, the welding means to be used is not especially limited and may be selected arbitrarily from various welding means such as a thermal welding means, a high-frequency welding means, and an ultrasonic welding means.

In this case, the slider 20 is not attached to the fastener chain 10. Thus, by applying heat to and near the adhesive film 6 with the fastener chain 10 pressed against the fastener receiving member 5 at a predetermined pressure, the fastener chain 10, adhesive film 6, and fastener receiving member 5 can be welded and integrated over the entire length of the fastener chain 10 in a single welding operation.

Then, the slider 20 is attached to the element rows 12 of the fastener chain 10 welded to the fastener receiving member 5 (step 2*e* of FIG. 27). In the second embodiment, a separated portion 12*a* where the element rows 12 of the fastener chain 10 are partially separated is formed before the welding. Thus, after completion of the welding, the first segmented slider 20 is formed by assembling the first and second slider members 31 and 32 described in the first embodiment and attached to the separated portion 12*a* of the element rows 12.

As a result, the slide fastener 15 in which the first segmented slider 20 has been slidably attached to the element rows 12 is formed. Also in the second embodiment, as in the above-described first embodiment, other sliders such as the second to fourth segmented sliders 40 to 80 as described above can be used in place of the first segmented slider 20.

Thus, in the second embodiment, after the element rows 12 of the fastener chain 10 are partially forcibly separated, the resultant fastener chain 10 is welded to and integrated with the fastener receiving member 5 through the adhesive film 6 in a single welding operation, whereby a product in which the slide fastener 15 has been attached to the fastener receiving member 5 can be produced.

Thus, in the second embodiment, as in the above-described first embodiment, the fastener chain 10 can be effectively attached to the fastener receiving member 5 in a single welding operation, so that work efficiency is improved, and reduction of production cost can be expected.

Further, it is possible to suppress occurrence of a defect such as formation of a stepped portion in the welding portion between the fastener chain 10 and fastener receiving member 5 or a change in color of the welding portion. Furthermore, when the high-frequency welding means is used as the welding means, it is possible to reduce a possibility that the sparking occurs upon welding, thereby suppressing reduction in product quality or product yield due to occurrence of the sparking.

In the above first and second embodiments, the fastener chain 10 for so-called a normal type slide fastener in which the element rows 12 are formed in the tape side edge portions of the respective fastener tapes 11 is attached to the fastener receiving member 5 with the coupling head of the fastener element 13 protruding from the tape side edge of the fastener tape 11.

However, the invention is not limited to the above, but can be applied to, for example, a case where a fastener chain for so-called a concealed slide fastener is attached to the fastener receiving member 5. The concealed slide fastener is configured as follows. That is, a tape side edge portion of the fastener tape is folded in a substantially U-shape, and the element row is formed at the tape side edge portion of the fastener tape with the coupling head of the fastener element protruding from the substantially U-shaped tape folded portion. In this concealed slide fastener, the left and right element rows are concealed by the respective left and right fastener tapes in a state where the left and right element rows are coupled to each other, thereby making it possible to prevent the element rows from being seen from a fastener surface on a side opposite to a fastener surface on which the element rows are provided.

When such a concealed slide fastener is attached to the fastener receiving member, the fastener chain for concealed slide fastener to which the slider has not been attached and fastener receiving member are integrated with each other by welding or bonding, and then the slider is attached to the resultant fastener chain. As such a slider, a segmented slider as described in WO 2011/024273 A can be used.

Specifically, this segmented slider includes a slider body and a tab rotatably retained by the slider body. The slider body includes a lower blade, left and right side wall portions erected along respective left-right direction side edges of the lower blade, left and right first flange portions extending in directions approaching each other from upper ends of the respective left and right side edge portions, a guide post erected at a left-right direction center portion of the lower blade and between the left and right first flange portions, a second flange portion protruding from an upper end portion of the guide post toward the left and right first flange portions and a rear opening side, and a tab attaching portion provided at the upper end of the guide post so as to support the tab. Further, in the slider body, an element guide passage is formed so as to be surrounded by the lower blade, left and right side edge walls, left and right first flange portions, and second flange portion.

The slider body includes first and second slider members capable of being engaged with each other through the guide post. The first slider member includes the lower blade, left and right side wall portions, left and right first flange portion, and a first post portion constituting a part of a guide post. The first post portion has a fitted portion to which the second slider member is fitted. The second slider member includes a second post portion constituting the remaining part of the guide post, second flange portion, and tab attaching portion. Further, the second post portion has a fitting portion to be fitted to the fitted portion of the first slider member.

In this case, of the members that form an element guide passage so as to allow insertion of the element rows into the element guide passage when the first and second slider members are assembled, the lower blade, left and right side wall portions, and left and right first flange portions are included in the first slider member. Further, of the members that form the element guide passage, the second flange portion is included in the second slider member.

The segmented slider formed by the thus configured first and second slider members can be easily assembled to each other by assembling the second post portion to first post portion in such a manner as to fit the fitting portion of the second slider member to the fitted portion of the first slider member.

Thus, using such a segmented slider, when the concealed slide fastener is attached to the fastener receiving member, the fastener chain to which the slider has not been attached and fastener receiving member are integrated with each other by welding or bonding. After that, the segmented slider configured as described above can be attached to the fastener chain for the concealed slide fastener integrated with the fastener receiving member. Thus, as in the above first and second embodiments, work efficiency when the concealed slide fastener is attached to the fastener receiving member is improved, and reduction of production cost can be expected.

REFERENCE SIGNS LIST

1*a* to 1*e* Step
2*a* to 2*e* Step
5 Fastener receiving member
5*a* Opening
6 Adhesive film
6*a* Opening
7 Product
8 Element separating member (jig)
10 Fastener chain
11 Fastener tape
12 Element row
12*a* Portion at which element rows are separated
13 Fastener element (normal element)
13*a* Fastener element (weakly coupled element)
14 Fragile portion
15 Slide fastener
20 Slider (first segmented slider)
21 Slider body
22 Upper blade (first blade)
22*a* First bulge portion
22*b* Second bulge portion
23 Lower blade (second blade)
23*a* Third bulge portion
24 Guide post
25 Tab attaching post
26 Base
26*a* Base body
26*b* Foundation
26*c* Extending portion
27 Lower flange portion
27*a* Flange forming portion
28 Element guide passage
31 First slider member
31*a* First fitted portion (fit-in concave portion)
31*b* Second fitted portion (projected rim portion)
31*c* Positioning portion
42 Second slider member
32*a* First fitting portion (hook portion)
32*b* Second fitting portion (concave groove portion)
40 Second segmented slider
41 Slider body
42 Upper blade
43 Lower blade
44 Guide post
45 Tab attaching post
46 Base
46*a* Base body
46*b* Foundation
46*c* Tongue piece portion
47 Lower flange portion
47*a* Flange forming portion
48 Element guide passage
51 First slider member
51*a* First fitted portion (fit-in concave portion)
51*b* Second fitted portion (fit-in concave portion)
52 Second slider member
52*a* First fitting portion
52*b* Second fitting portion
60 Third segmented slider
61 Slider body
62 Upper blade
62*a* First bulge portion
62*b* Second bulge portion
63 Lower blade
63*a* Third bulge portion
64*a* First guide post
64*b* Second guide post
65 Tab attaching post
67 Lower flange portion
71 First slider member
71*a* First fitted portion (dovetail groove portion)
71*b* Second fitted portion (recess)
71*c* Insertion hole portion
71*d* Insertion groove portion
72 Second slider member
72*a* First fitting portion
72*b* Second fitting portion
72*c* Insertion hole portion
72*d* Post body
72*e* Insertion hole portion
73 Split pin member
73*a* Slit
80 Fourth segmented slider
81 Slider body
82 Upper blade
82*a* First bulge portion
82*b* Second bulge portion
83 Lower blade
83*a* Third bulge portion
84*a* First guide post
84*b* Second guide post
85 Tab attaching post
87 Lower flange portion
88 Swelling portion
91 First slider member
91*a* Insertion hole portion
92 Second slider member
92*a* Insertion hole portion
92*b* Post insertion hole portion
93 Split pin member

The invention claimed is:

1. A slide fastener attachment method, the method including:

forming an opening having a predetermined length on a fastener receiving member;

integrating a fastener chain to which a slider has not been attached and the fastener receiving member by welding or bonding, wherein the fastener chain has a pair of left and right fastener tapes, each of the fastener tapes has an element row with plurality of fastener elements, and the element rows are coupled to each other, so the opening of the fastener receiving member corresponds to a position of the coupled element rows;

forming a separated portion in the coupled element rows by separating a portion of the engaged fastener elements of the fastener chain; and attaching a slider to the separated portion of the element rows in the fastener chain after integration of the fastener chain and the fastener receiving member.

2. The slide fastener attachment method according to claim 1, wherein the slider has a plurality of slider members capable of being assembled to each other and configured as a segmented slider in which the element rows can be inserted into an element guide passage of the slider at assembly of the plurality of slider members, and the attachment method includes:

assembling the segmented slider and attaching the assembled segmented slider to the separated portion of the element rows at the same time.

3. The slide fastener attachment method according to claim 1, including:

integrating the fastener chain in which the element rows are coupled to each other with the fastener receiving member through an adhesive film in a single welding operation.

4. The slide fastener attachment method according to claim 3, including temporarily bonding the adhesive film to the fastener receiving member before the welding.

5. The slide fastener attachment method according to claim 1, wherein separating a portion of the engaged fastener elements includes using an element separating member.

6. The slide fastener attachment method according to claim 1, wherein the element rows include a fragile portion at which a coupling strength is lower than that of the other portions of the element rows.

7. The slide fastener attachment method according to claim 1, wherein the slider has at least a first slider member and a second slider member capable of being assembled to each other, and an inner wall surface of an element guide passage of the slider through which the element rows are inserted is formed by the first slider member and second slider member.

8. The slide fastener attachment method according to claim 7, wherein the slider has a fixing member for retaining a state where the first slider member and second slider member are engaged with each other, the first slider member has a first blade, a first guide post vertically installed on the first blade, and an insertion hole portion into which the fixing member is inserted, and the second slider member has a second blade, a second guide post erected on the second blade so as to be engaged with the first guide post of the first slider member, and an insertion hole portion into which the fixing member is inserted.

* * * * *